US011011339B2

(12) United States Patent
Park

(10) Patent No.: US 11,011,339 B2
(45) Date of Patent: May 18, 2021

(54) MAGNETRON

(71) Applicant: Soo Yong Park, Seoul (KR)

(72) Inventor: Soo Yong Park, Seoul (KR)

( * ) Notice: Subject to any disclaimer, the term of this patent is extended or adjusted under 35 U.S.C. 154(b) by 0 days.

(21) Appl. No.: 14/764,437

(22) PCT Filed: Mar. 3, 2014

(86) PCT No.: PCT/US2014/019819

§ 371 (c)(1),
(2) Date: Jul. 29, 2015

(87) PCT Pub. No.: WO2014/134595

PCT Pub. Date: Sep. 4, 2014

(65) Prior Publication Data

US 2015/0380198 A1 Dec. 31, 2015

Related U.S. Application Data

(60) Provisional application No. 61/771,559, filed on Mar. 1, 2013, provisional application No. 61/771,594, filed
(Continued)

(51) Int. Cl.
*H01J 23/20* (2006.01)
*H01J 23/05* (2006.01)
(Continued)

(52) U.S. Cl.
CPC ..... *H01J 23/005* (2013.01); *H01J 1/28* (2013.01); *H01J 9/18* (2013.01); *H01J 9/26* (2013.01);
(Continued)

(58) Field of Classification Search
CPC ..... H01J 23/02; H01J 23/05; H01J 23/075; H01J 23/08; H01J 25/587; H01J 25/50;
(Continued)

(56) References Cited

U.S. PATENT DOCUMENTS 2,477,122 A * 7/1949 Garner ..... H01J 23/165 220/2.2
2,647,216 A 7/1953 Brown
(Continued)

FOREIGN PATENT DOCUMENTS

CN 1503304 A 6/2004

OTHER PUBLICATIONS

International Search Report dated Aug. 18, 2014, for International Patent Application No. PCT/US2014/019819.

*Primary Examiner* — Tung X Le
*Assistant Examiner* — Henry Luong
(74) *Attorney, Agent, or Firm* — Kile Park Reed & Houtteman PLLC

(57) ABSTRACT

A 4G magnetron is disclosed. The magnetron may include an anode, having a cylindrical member and anode vanes disposed within the cylindrical member which define resonant cavities therebetween, and a dispenser cathode, suitable for heating and located coaxially within said anode. The magnetron may operate in a temperature range of about 850-1050 C. The magnetron may include conductive cooling. The magnetron may comprise inventive anode and cathode structures. A method for preparing a plurality of magnetron tubes substantially simultaneously is further provided.

10 Claims, 25 Drawing Sheets

Related U.S. Application Data on Mar. 1, 2013, provisional application No. 61/771,602, filed on Mar. 1, 2013, provisional application No. 61/771,613, filed on Mar. 1, 2013, provisional application No. 61/779,107, filed on Mar. 13, 2013.

(51) Int. Cl.

| | |
|---|---|
| ***H01J 25/587*** | (2006.01) |
| ***H01J 23/00*** | (2006.01) |
| ***H01J 9/385*** | (2006.01) |
| ***H01J 23/12*** | (2006.01) |
| ***H01J 9/18*** | (2006.01) |
| ***H01J 9/26*** | (2006.01) |
| ***H01J 25/50*** | (2006.01) |
| ***H01J 1/28*** | (2006.01) |

(52) U.S. Cl.
CPC ..... *H01J 9/385* (2013.01); *H01J 23/05* (2013.01); *H01J 23/12* (2013.01); *H01J 25/50* (2013.01); *H01J 25/587* (2013.01)

(58) Field of Classification Search
CPC ..... H01J 23/00; H01J 23/005; H01J 23/11; H01J 23/12; H01J 23/20; H01J 23/16; H01J 23/48; H01J 25/00; H01J 9/18; H01J 9/26; H01J 9/385; H01J 1/28; H01J 19/00; H01J 19/80; H01J 21/18
USPC ..... 315/39.51, 111.01–111.91, 39.63, 39.71
See application file for complete search history.

(56) References Cited

U.S. PATENT DOCUMENTS

| | | | | | |
|---|---|---|---|---|---|
| 2,653,275 | A * | 9/1953 | Everhart | H01J 23/22 | 192/125 F |
| 2,957,100 | A | 10/1960 | Espersen et al. | | |
| 3,297,901 | A | 1/1967 | Macdonald et al. | | |
| 3,308,329 | A | 3/1967 | Foreman et al. | | |
| 3,315,121 | A * | 4/1967 | Staats | H01J 23/05 | 219/756 |
| 3,381,168 | A * | 4/1968 | Gerard | H01J 23/00 | 315/39.75 |
| 3,514,324 | A * | 5/1970 | Koppius | C23C 16/16 | 313/346 R |
| 3,681,652 | A * | 8/1972 | Domenichini | H01J 23/14 | 315/39.51 |
| 3,989,979 | A * | 11/1976 | Konno | H01J 23/10 | 315/39.51 |
| 4,028,583 | A | 6/1977 | Bigham | | |
| 4,179,639 | A * | 12/1979 | Derby | H01J 23/22 | 228/115 |
| 4,223,246 | A * | 9/1980 | Osepchuk | H01J 23/10 | 313/38 |
| 4,494,034 | A | 1/1985 | Keller | | |
| 4,831,341 | A * | 5/1989 | Brady | H01J 23/213 | 315/39.61 |
| 4,891,557 | A * | 1/1990 | Nobue | H01J 23/22 | 315/39.51 |
| 5,548,105 | A * | 8/1996 | Butterworth | H01J 23/005 | 219/748 |
| 5,635,798 | A * | 6/1997 | Ogura | H01J 23/10 | 315/39.51 |
| 6,113,731 | A * | 9/2000 | Shan | H01J 37/32623 | 118/723 MA |
| 6,339,294 | B1 * | 1/2002 | Brady | H01J 23/10 | 315/39.69 |
| 6,693,378 | B1 * | 2/2004 | Shon | H01J 23/11 | 315/39.51 |
| 8,471,453 | B2 * | 6/2013 | Guyot | H01J 27/02 | 313/359.1 |
| 2004/0100199 | A1 | 5/2004 | Yang | | |
| 2009/0058305 | A1 * | 3/2009 | Hofer | B64G 1/405 | 315/111.91 |
| 2013/0015182 | A1 * | 1/2013 | Akutsu | H01J 25/50 | 219/761 |
| 2013/0082594 | A1 * | 4/2013 | Fox | H01J 23/05 | 315/39.51 |

* cited by examiner

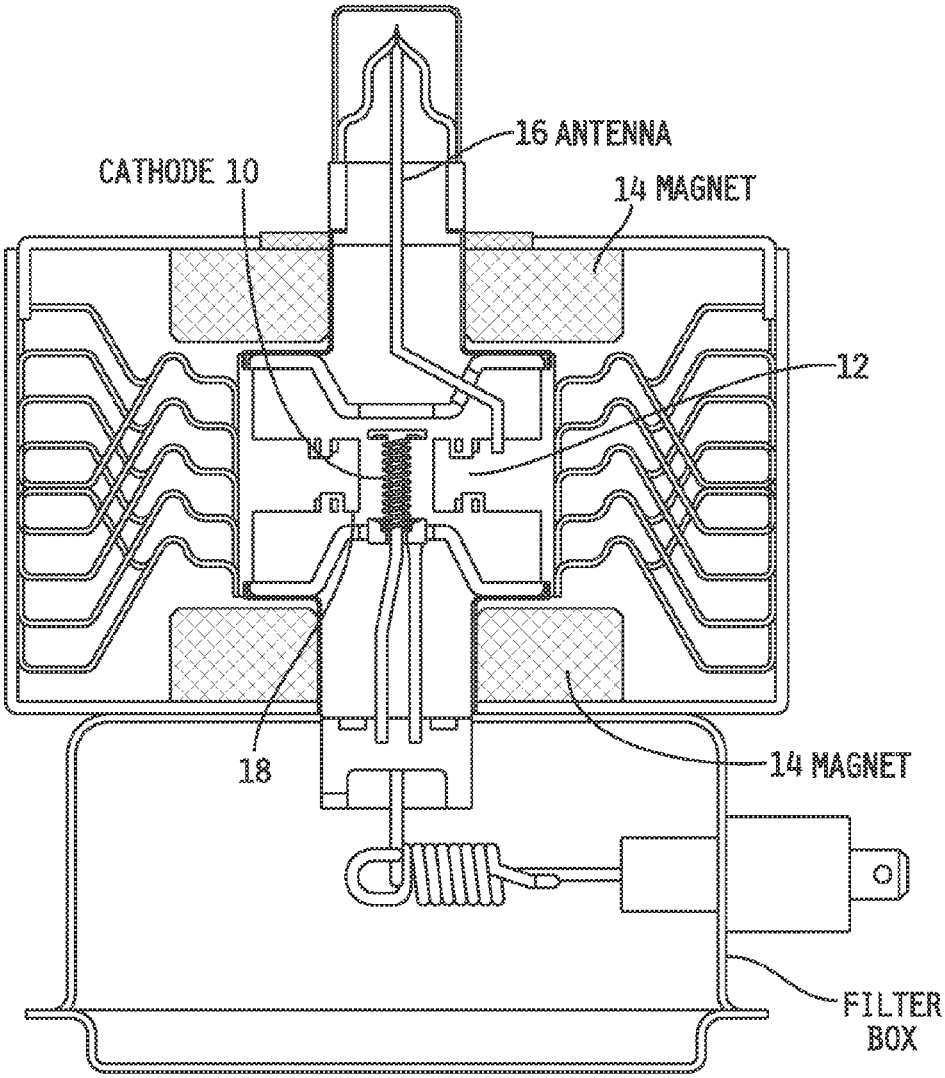
FIG. 1 MAGNETRON

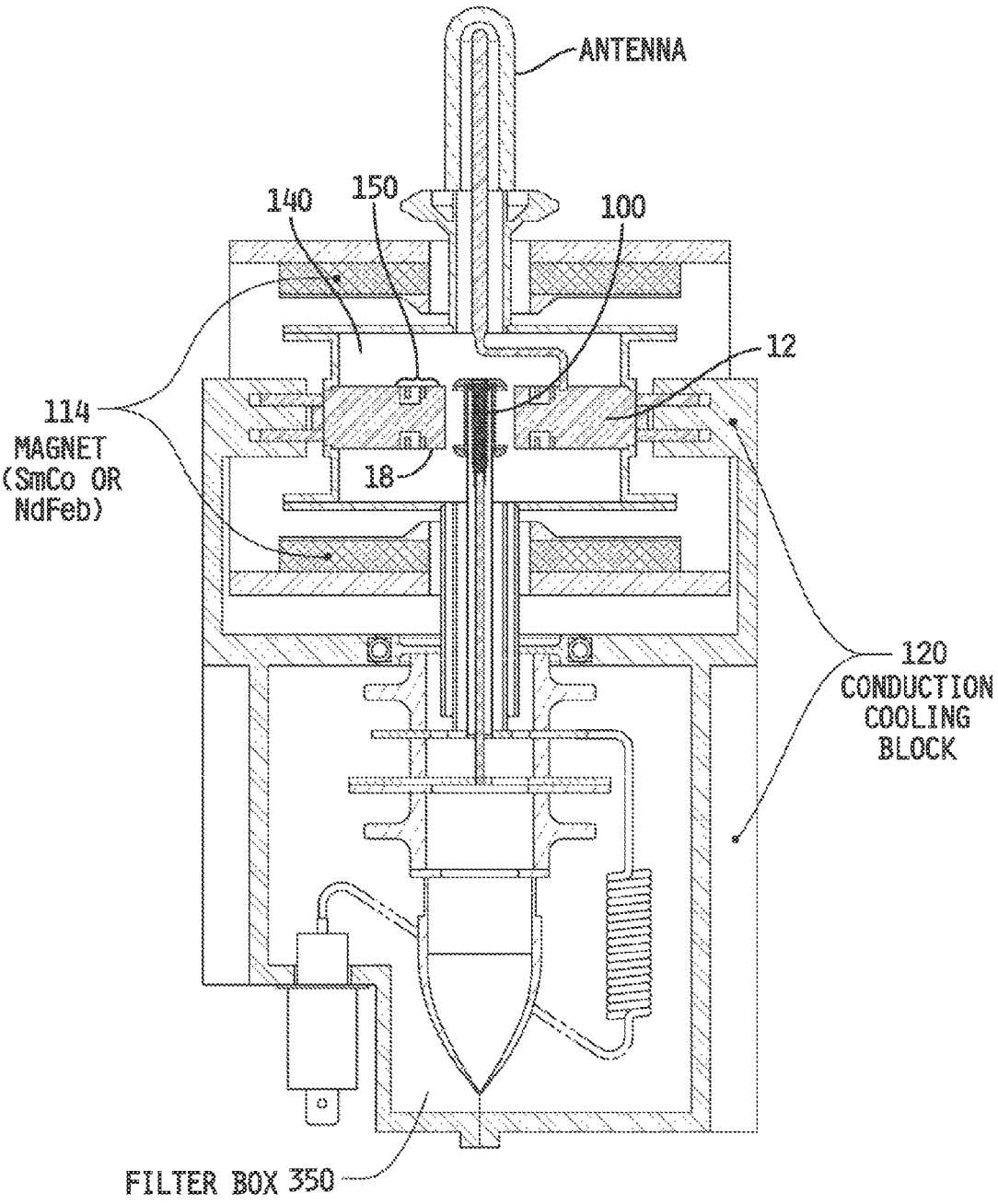
FIG. 2 MAGNETRON

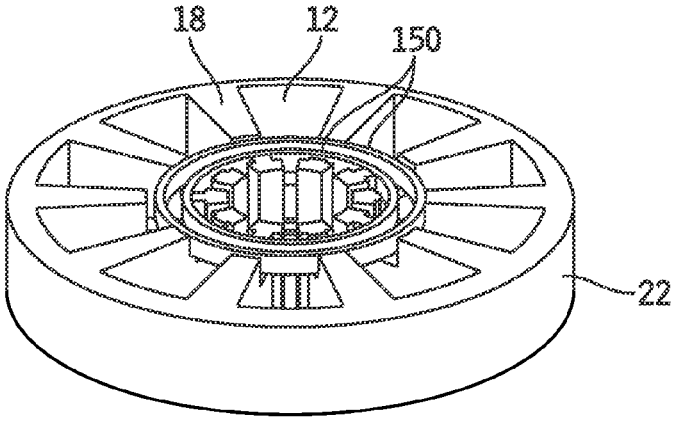
FIG. 4A STRAP RINGS
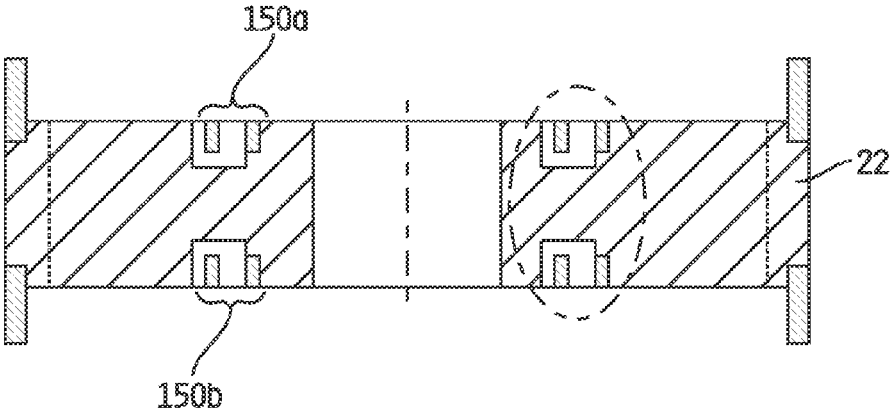
FIG. 4B SYMMETRIC STRAP RINGS

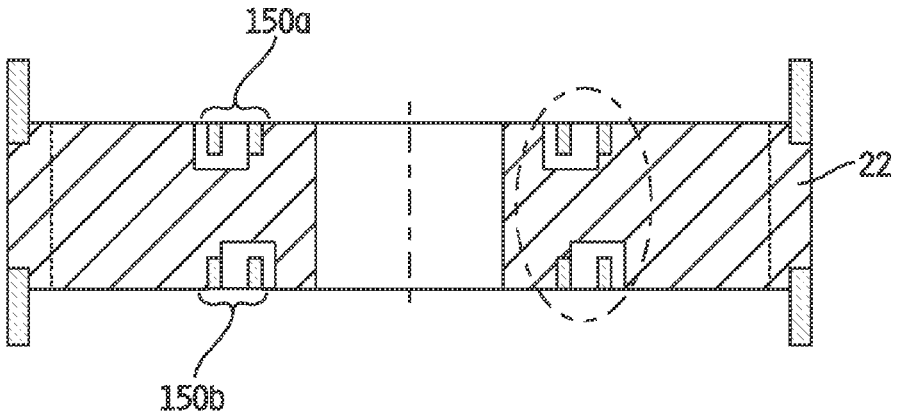
FIG. 4C ANTI-SYMMETRIC STRAP RINGS
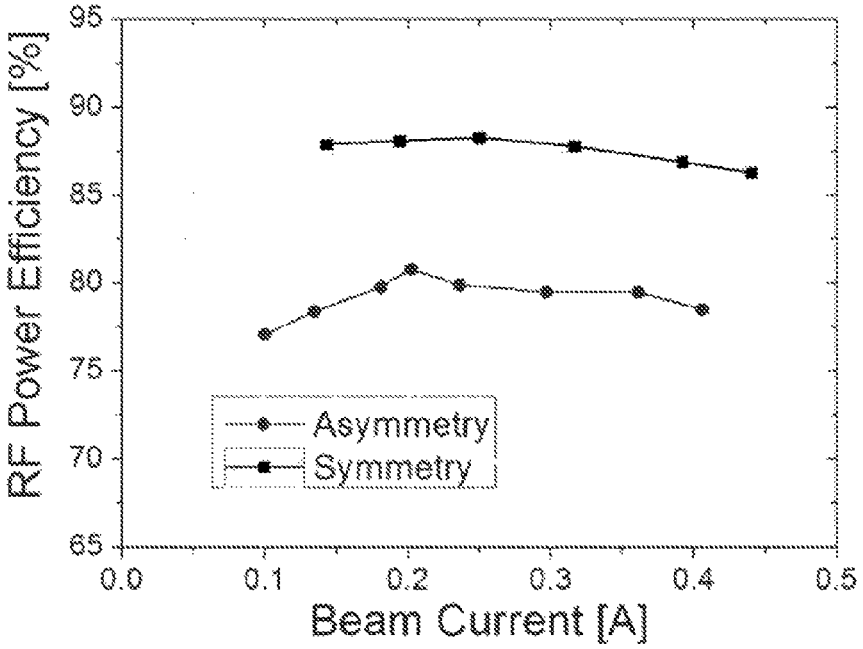
FIG. 5A POWER EFFICIENCY

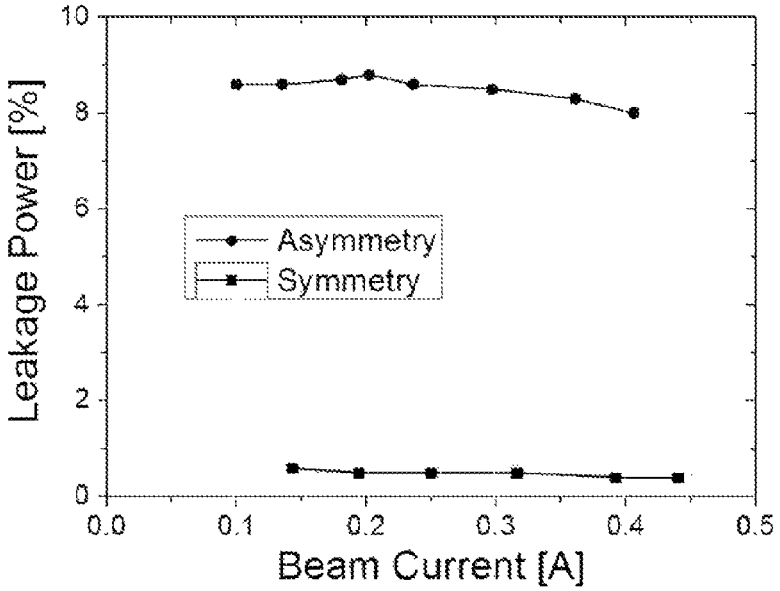
FIG. 5B LEAKAGE POWER
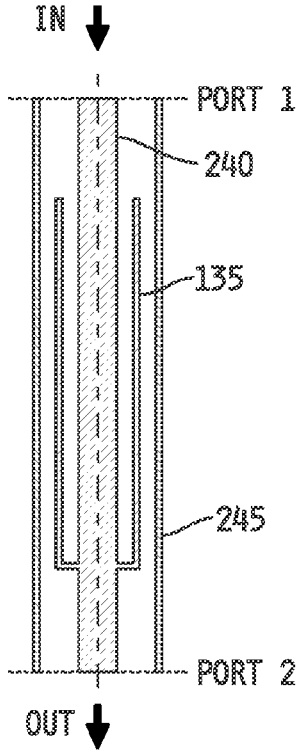
FIG. 6A
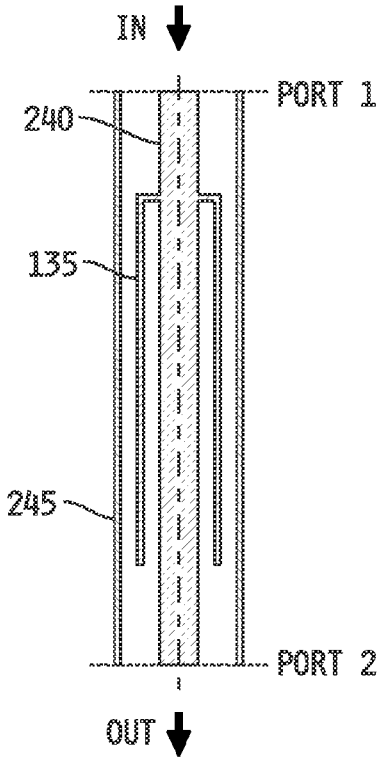
FIG. 6B

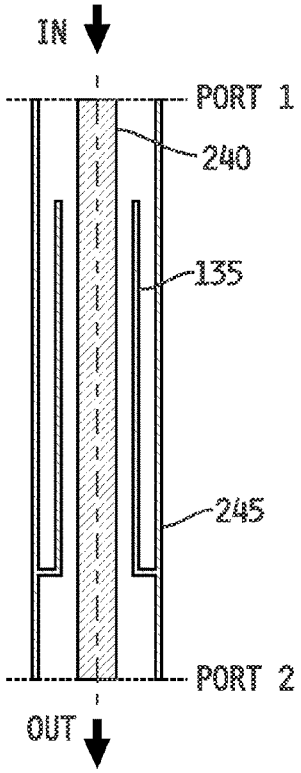
FIG. 6C
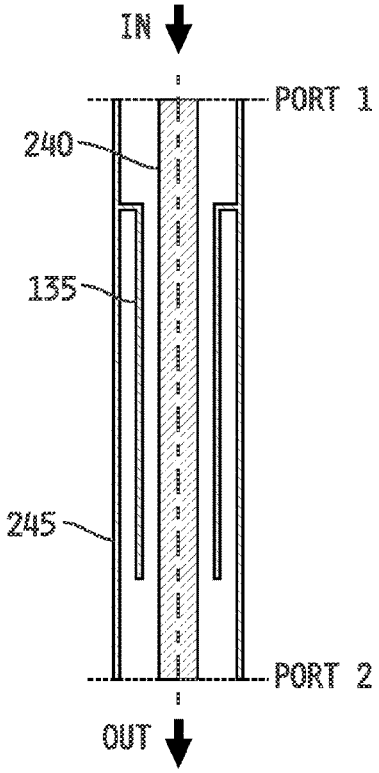
FIG. 6D
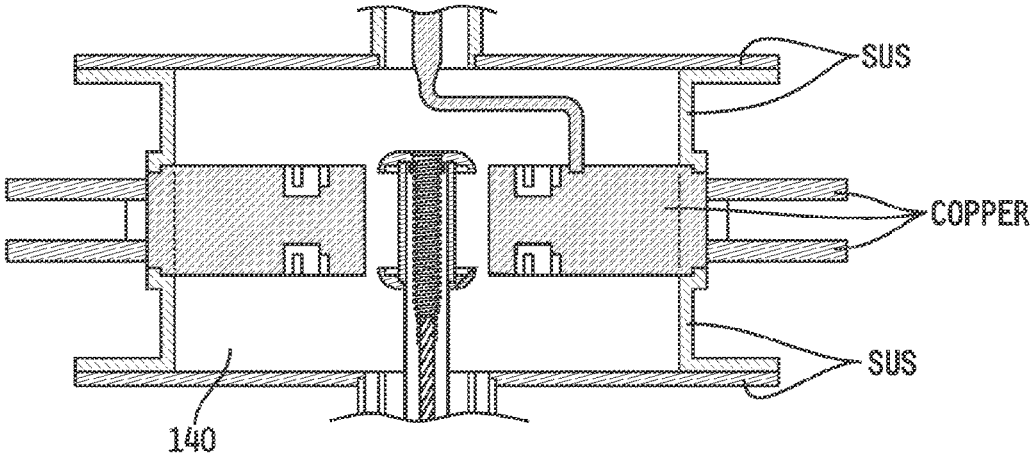
FIG. 7 LOW PROFILE MAGNETRON

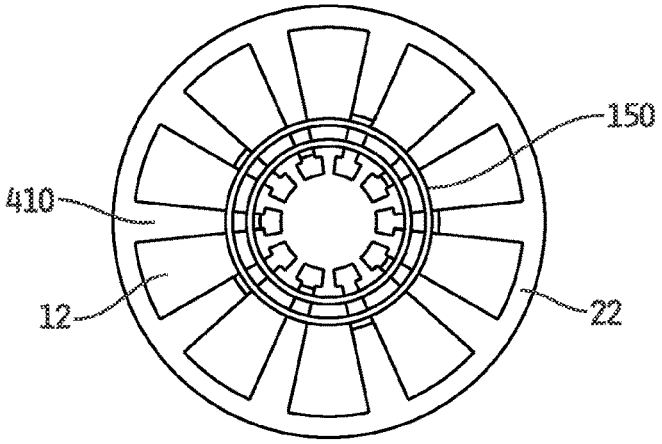
FIG. 12 WEDGE TYPE ANODE VANES
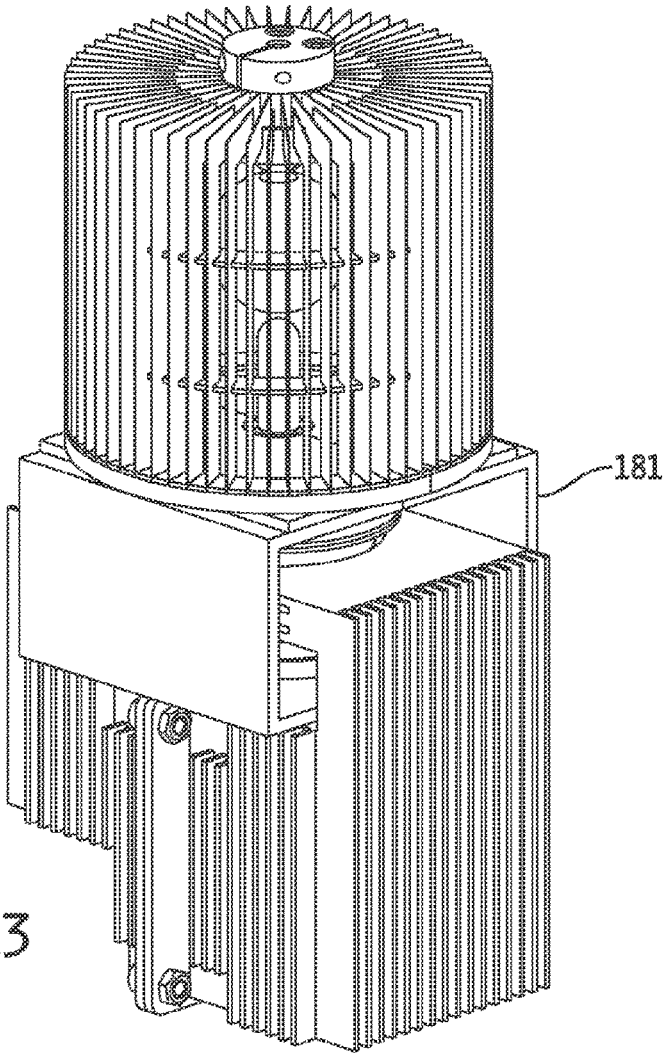
FIG. 13

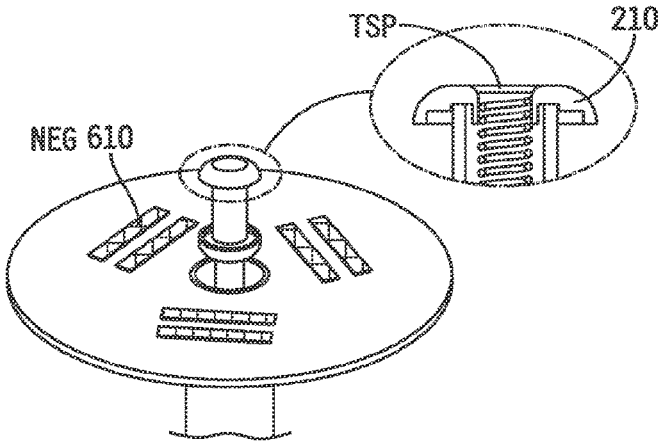
FIG. 18
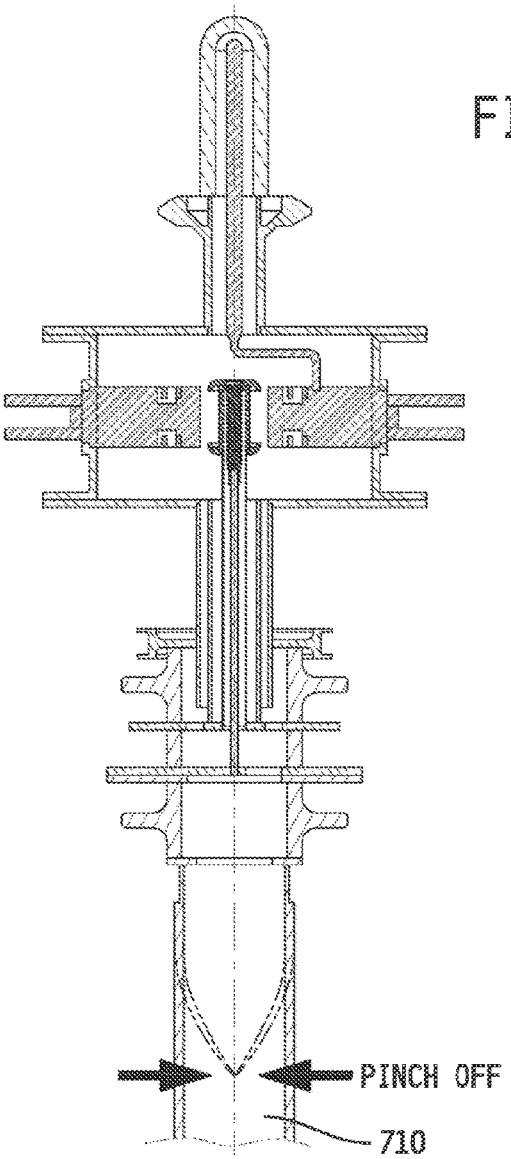
FIG. 19 PUMPING PORT

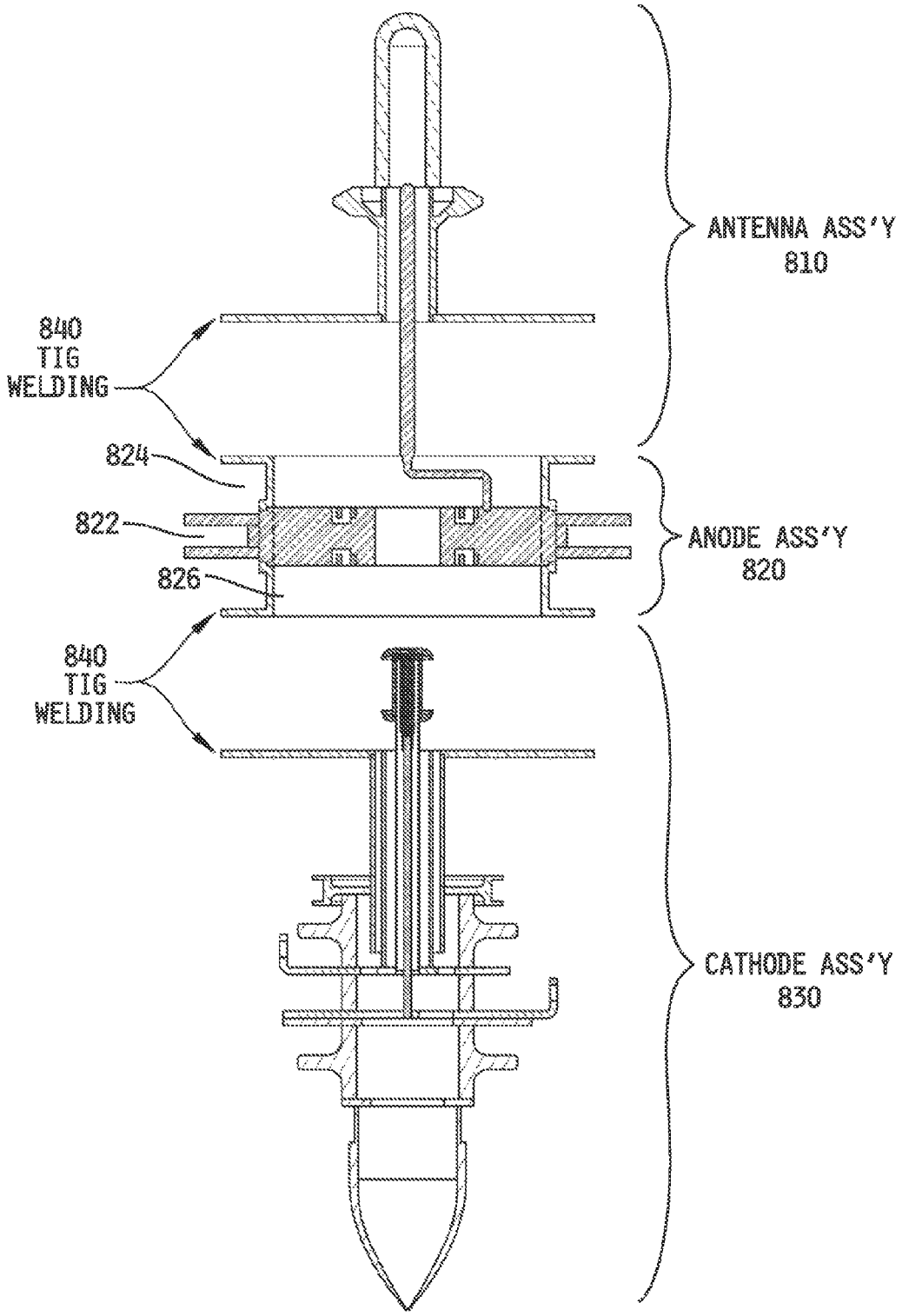
FIG. 20 THREE ASSEMBLIES

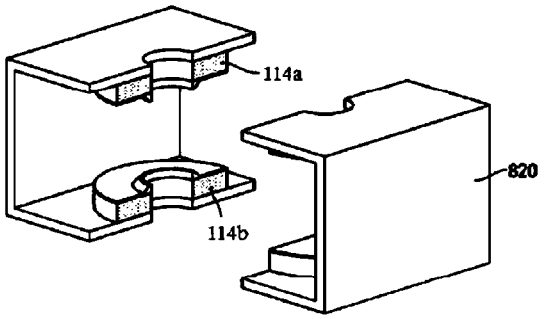
FIG. 21A MAGNET CIRCUIT - RECTANGULAR
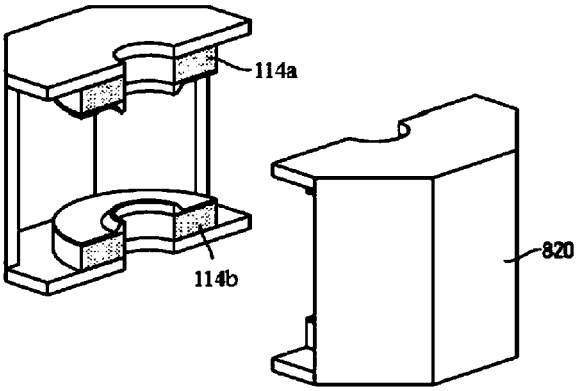
FIG. 21B MAGNET CIRCUIT - OCTAGONAL

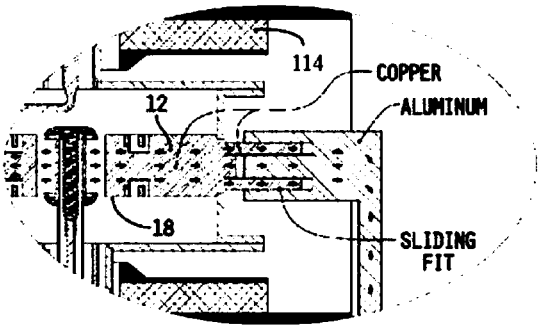
FIG. 23 HEAT FLOW/SLIDING FIT
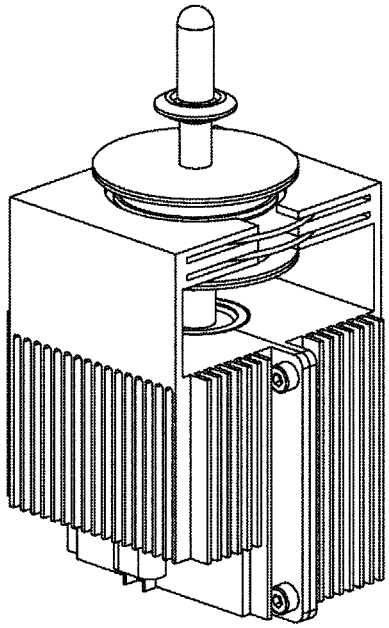
FIG. 24 COOLING PLATES AND THE CATHODE SHIELD COVERS

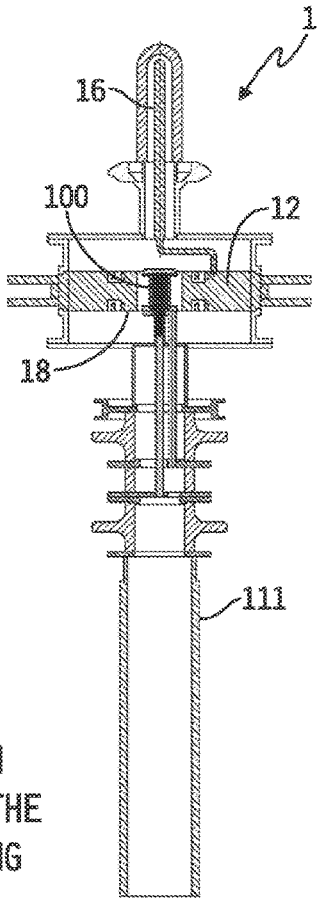
FIG. 26
THE 4G MAGNETRON TUBE READY FOR THE FINAL POROCESSING
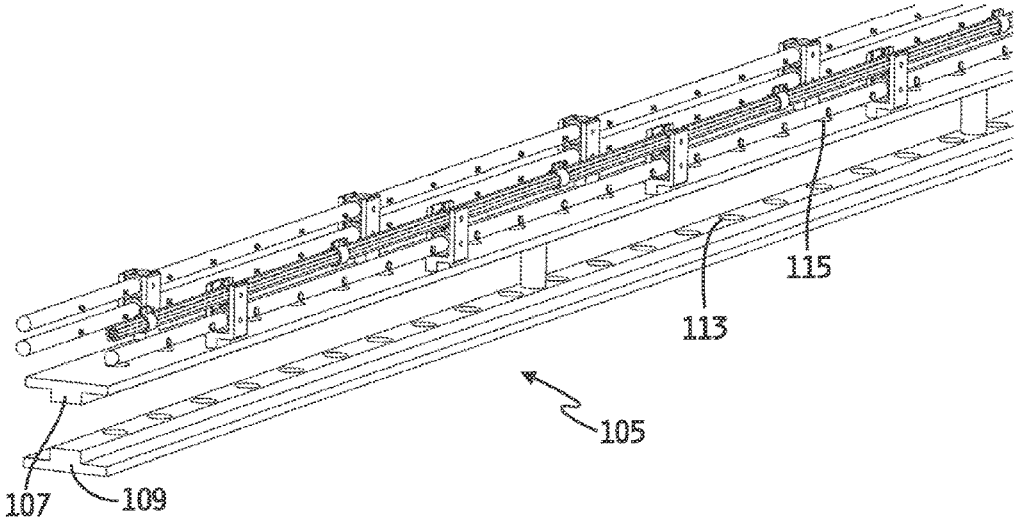
FIG. 27A PROCESSING TRAY FOR THE FINAL PROCESSING

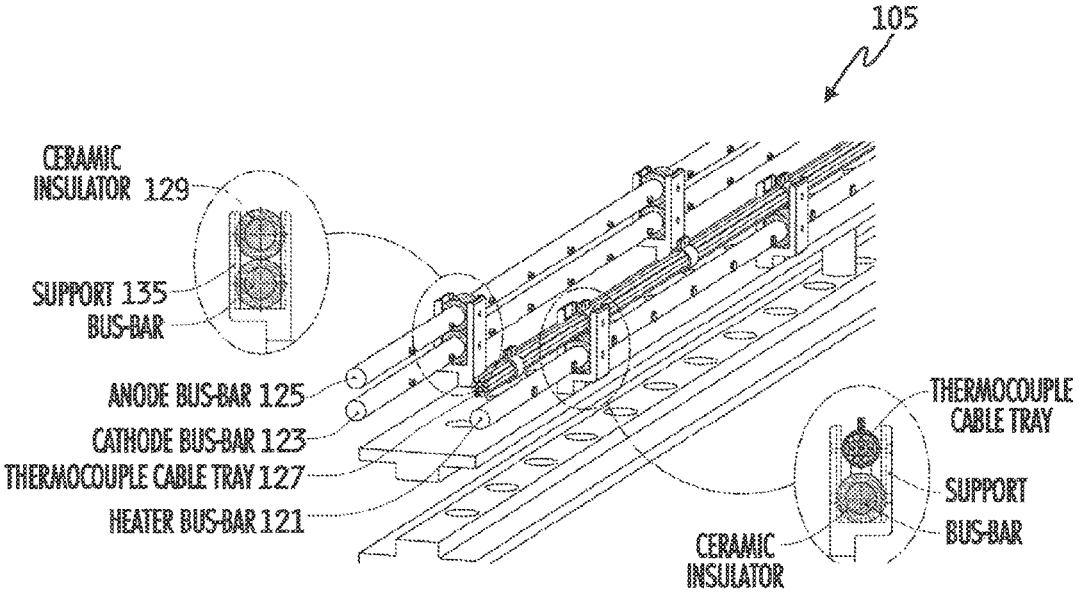
FIG. 27B BUS-BARS AND TC CABLE TRAY
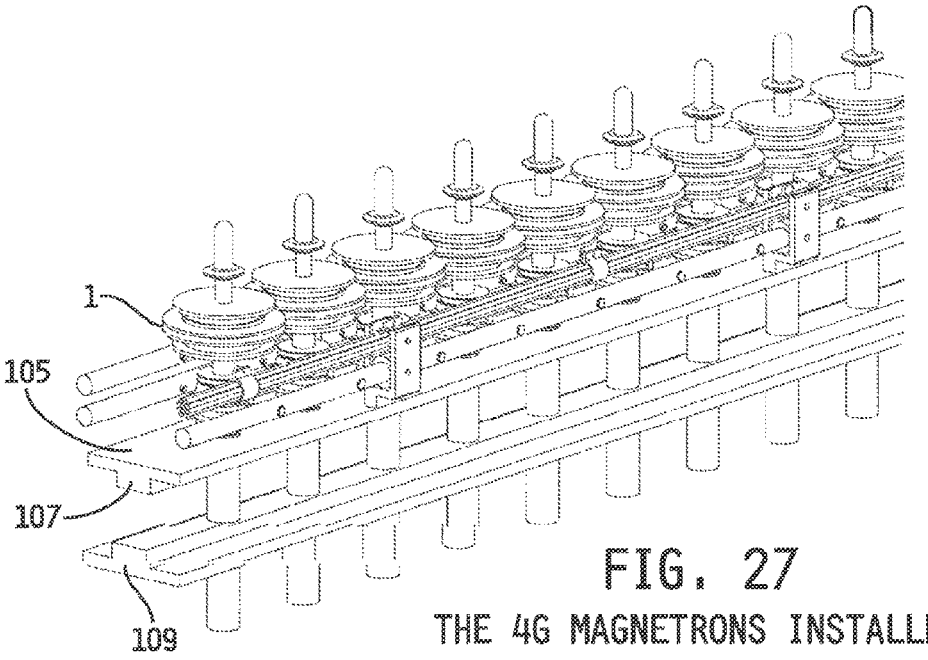
FIG. 27
THE 4G MAGNETRONS INSTALLED ON THE PROCESSING TRAY THE HEATER, CATHODE AND ANODE TERMINALS ARE CONNECTED TO THE BUS-BARS. THE TC SENSOR CABLE IS CONNECTED TO THE ONE MAGNETRON OUT OF FIVE

10" VACUUM FLANGE FOR THE FRONT END OF THE PROCESSING TRAY

THE PROCESSING TRAY INSTALLED IN THE PROCESSING CHAMBER

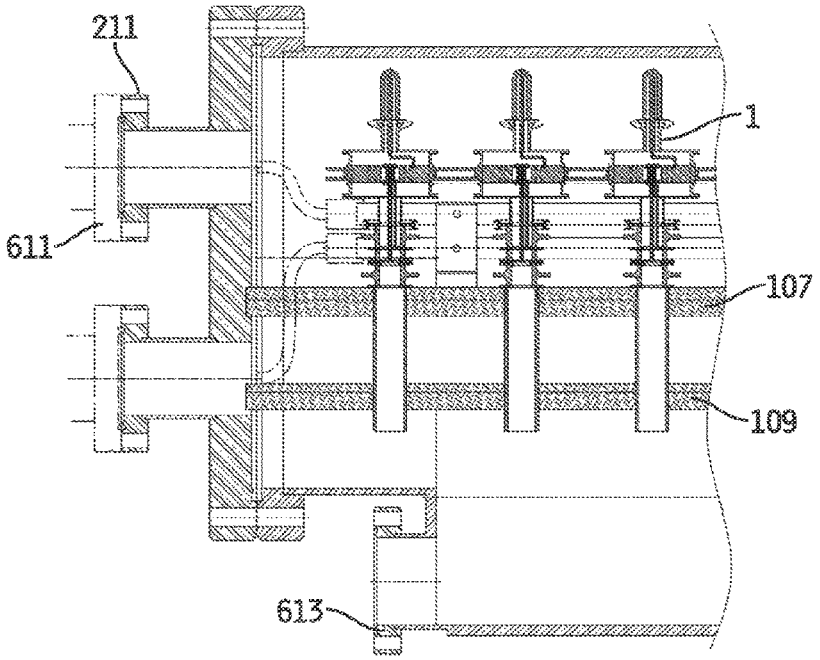
FIG. 29B
THE FRONT END OF THE PROCESSING CHAMBER WITH THE PROCESSING TRAY INSTALLED
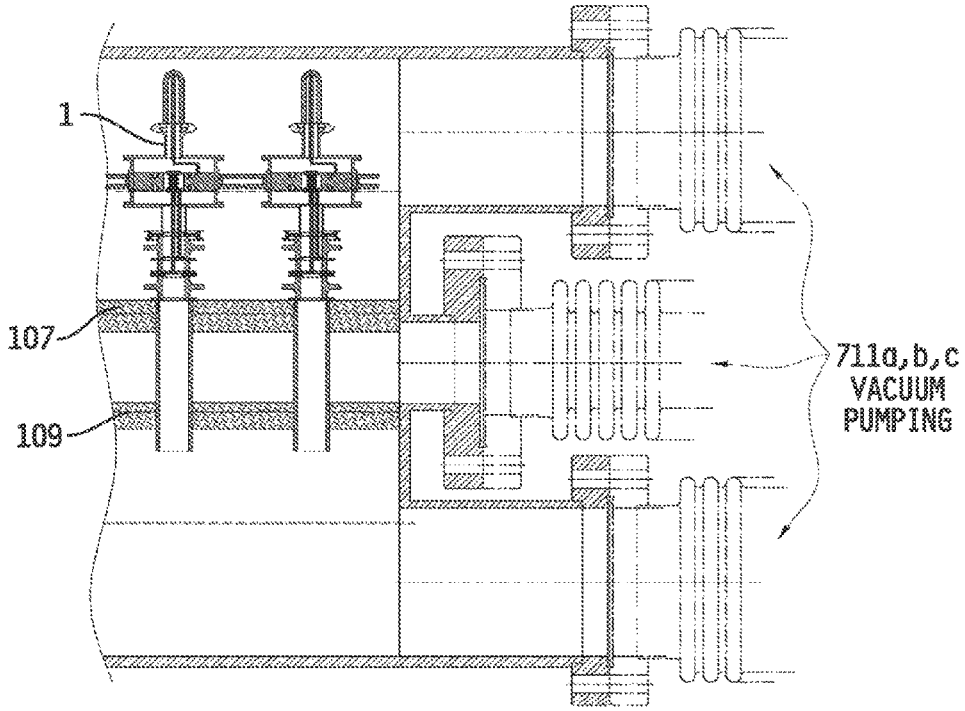
FIG. 29C THE REAR END OF THE PROCESSING CHAMBER WITH THE PROCESSING TRAY INSTALLED

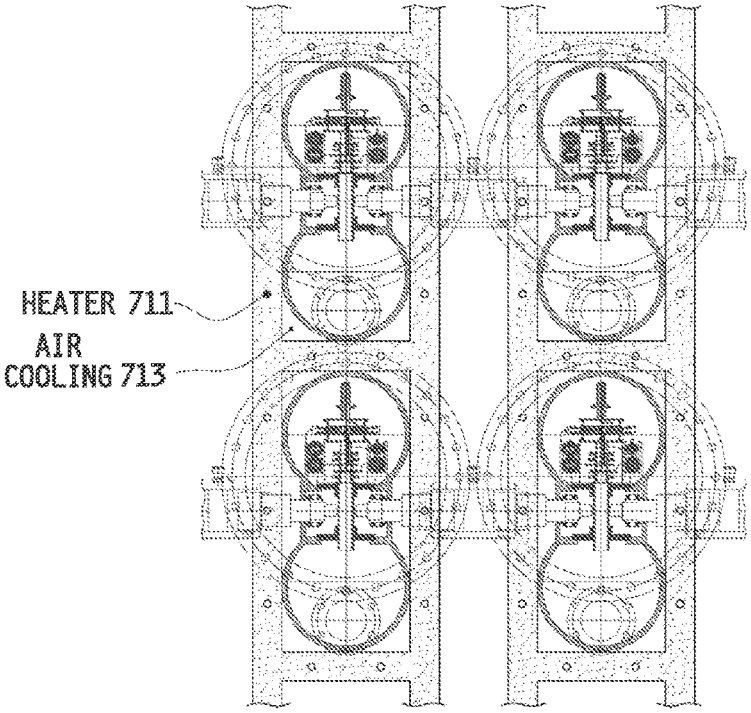
FIG. 30 PINCHING OFF COMPLETED
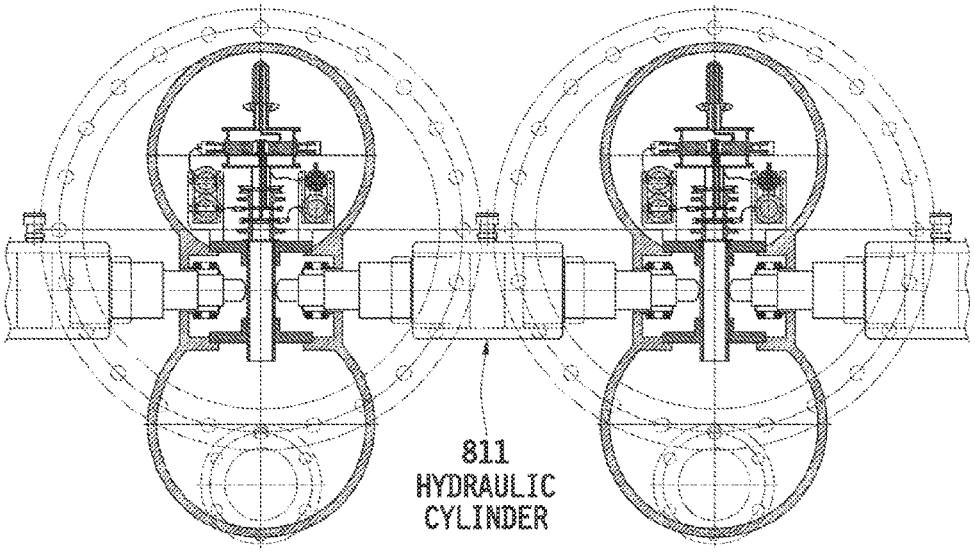
FIG. 31A
HEATING JACKETS WITH HEATING STRIPS EMBEDDED. COOLING IS DONE BY FORCED AIR BETWEEN THE PROCESSING CHAMBER AND THE HEATING JACKET.

THE PINCH OFF DEVICES; EACH HYDRAULIC PUMP WORKS IN BOTH DIRECTIONS TO COUNTER BALANCE THE REACTION FORCES.

THE TOP VIEW OF THE PINCH OFF SYSTEMS; TWO PAIRS OF THE HYDRAULIC PUMPS DRIVE A PAIR OF PINCH OFF KNIVES THAT CUT OFF THE MAGNETRON AT THE SAME TIME

MAGNETRON

CROSS-REFERENCE TO RELATED APPLICATIONS

This is a National Stage Entry into the United States Patent and Trademark Office from International PCT Patent Application No. PCT/US2014/019819, having an international filing date of Mar. 3, 2014, which application claims priority to United States Provisional Patent Application No. 61/771,559, filed Mar. 1, 2013, titled CONDUCTION COOLING OF A MAGNETRON FOR AN ELECTRODELESS LAMP, and to United States Provisional Patent Application No. 61/771,594, filed Mar. 1, 2013, titled LOW EM LEAKAGE MAGNETRON, and to United States Provisional Patent Application No. 61/771,602, filed Mar. 1, 2013, titled 4G MAGNETRON, and to United States Provisional Patent Application No. 61/779,107, filed Mar. 13, 2013, titled 4G MAGNETRON, and to United States Provisional Patent Application No. 61/771,613, filed Mar. 1, 2013, titled PROCESSING CHAMBER FOR THE 4G MAGNETRON, the entire contents of all of which are incorporated herein by reference.

This application is related to International PCT Patent Application No. PCT/US2014/019826, entitled "SULFUR LAMP" filed by the inventor hereof on Mar. 3, 2014.

FIELD OF INVENTION

The present invention relates to a magnetron, and, more particularly, to a so-called "4G" magnetron that may provide decreased operating temperature and lower electromagnetic leakage, and a processing method therefore.

BACKGROUND

A magnetron is a very efficient and economical source of microwave energy, and thus is widely used in a variety of applications, such as microwave ovens. A magnetron may also be used to provide power to, for example, a sulfur lamp, such as a street lamp, such as is disclosed in an application entitled "SULFUR LAMP", filed by the inventor hereof on even date herewith. For example, a sulfur lamp may be a microwave power-driven, electrodeless discharge lamp that may be driven by a magnetron. The magnetron in use in known ones of such an application is the so-called "3G" magnetron, which was originally developed for use in microwave ovens.

In typical embodiments of the 3G magnetron, the magnetron is adapted primarily for microwave oven use, has a short lifetime of about 3,000 hours, and has a high power available of about 700~1,300 W. Further, in general, the 3G magnetron is cooled by a fan, which has a motor and other moving parts, and has a cathode of the tungsten filament type (3% Thorium). Additionally, the 3G magnetron is typically of the direct heating type, has an operating temperature of ~1,800 C, and includes magnets of ferrite—which are generally bulky and sensitive to temperature.

Although a 3G magnetron is a very efficient and cheap source of microwave power suitable for oven use, it is not compatible with other uses, such as for the aforementioned street lighting purposes. One of the most serious problems for the 3G magnetron in these other applications, such as in uses for lighting, is the short lifetime of the 3G magnetron. For example, when compared with the lifetimes of other conventional discharge lamps, which are typically about 8,000 hours for the metal halide lamp and 12,000 hours for the sodium lamp, the lifetime of the 3G magnetron is very short. The lifetime may occasionally reach 10,000 hours, but is still far from satisfactory, particularly in certain applications such as street lighting.

A significant reason for the short lifetime of the 3G magnetron is the fact that a tungsten filament is used for the cathode. This type of cathode runs at high temperature, and the thorium added into the tungsten to help the electron emission thus evaporates quickly. It is very hard to substantially increase the lifetime of the 3G magnetron if this type of the cathode is used.

An additional issue with the 3G magnetron is the cooling fan, which requires an electric motor to drive it. Moving parts, such as the fan and the motor, eventually break down with the passage of time. Furthermore, the openings in the magnetron for the cooling fan may allow for entry of bugs and dust.

Nevertheless, because while generating microwaves magnetrons also generate heat, this heat must be quickly dissipated for proper operation. In the conventional magnetrons used in microwave ovens, many thin aluminum cooling fins are press fitted to the outside wall of the magnetron and cooled by forced air flow from the aforementioned cooling fan. Although this method of cooling is quite effective and adequate for domestic microwave ovens, it is unsuitable for use in lighting applications, especially lighting applications that require a nominal lifetime of many years with minimal maintenance, for various reasons. For example, the cooling fan motor can be a source of mechanical breakdown and service problems applications requiring a long lifetime with minimal maintenance. Furthermore, the cooling fan and motor consume more power than is needed strictly for certain applications, such as for lighting, and occupy more space than is needed strictly for lighting, which makes it more difficult than necessary to fit the magnetron into the space provided in existing lighting fixtures.

Most magnetrons have resonant cavities constructed with vanes formed of a highly electrically conductive material such as copper, which is also an excellent thermal conductor. Most of the heat sources in a magnetron are concentrated near the edges of the vanes disposed nearest to the magnetron cathode. In particular, the main heat sources include the cathode itself, which is heated by a cathode heater to produce free electrons. The cathode thus radiates heat directly onto the edges of the anode vanes that are facing the cathode and are in closest proximity to it. Moreover, the free electrons are influenced by a magnetic field and formed into rotating electron beams between the cathode and anode. Another source of considerable heat is current arising in the same anode vane edges that face the cathode, resulting from those free electrons as they lose energy to microwaves generated in the anode, and are collected at the vane tips of the anode.

Some components of the magnetron are sensitive to this heat, including the strap rings and the magnets. The strap rings are located close to the hot vane tips and are thus exposed to its high temperature. Unless the heat is removed quickly, it can cause thermal deformation of the strap rings that results in thermal fatigue and shortens their lifetime, and can also undesirably change the resonant frequency of the magnetron.

Another problem with a 3G magnetron is that a ferrite magnet is used to produce the magnetic field that is critical to proper operation of the magnetron. Although the ferrite magnet is an inexpensive way to create the magnetic field, it is bulky and sensitive to changes of temperature. Since the temperature coefficient of a ferrite magnet is large, it is not suitable for outdoor use, such as in street lighting. This is, in part, because the magnets' magnetic field strength is adversely affected by increasing temperatures, thereby adversely affecting the operation of the magnetron. In the prior art, the side wall of the magnetron anode is made entirely of a single copper block, and heat is conducted easily to the top and bottom of the anode where the magnets forming the magnetic field are disposed. Prior art magnetrons, such as those used in domestic microwave ovens, dissipate this heat, which would otherwise excessively heat the magnets, by coupling a plurality of thin aluminum vanes to the outside of the magnetron anode, and forcing air through the vanes by the fan driven by the motor.

Yet further, although the magnetron radiates most of its microwave power through an antenna, it is difficult to avoid a small amount of leakage of electromagnetic (EM) power from aspects of the magnetron, such as through high voltage power lines of the cathode of the magnetron. This leakage adversely affects magnetron operation.

Efforts have been made to reduce or shield the EM leakage of a magnetron through its cathode end. Such efforts have been made because, for example, even a very low level of EM leakage may interfere with computers, communication devices, sensors, and the like. The regulation of electromagnetic compatibility (EMC) levels is expected to be much stricter in certain applications, such as for street lighting applications, than for other uses, such as for domestic oven uses.

Three stages of efforts to suppress the EM leakage may be exercised to meet regulatory and performance requirements. The first stage is to control the source side, i.e., to design and operate the magnetron in such a way that the portion of the microwave leaking toward the cathode end is minimized. The second stage is to absorb or block the microwave power propagating toward the outside of the magnetron. The third stage is to shield, i.e., to enclose, the entire cathode end by a shield box.

In most of the magnetrons used in domestic microwave ovens, for example, the top and the bottom concentric ones of the aforementioned strap ring pairs short circuit the aforementioned vanes that form the anode of the magnetron in order to limit EM leakage. Strap rings are typically attached to the anode vanes alternately in prior embodiments. That is, if a one of the concentric top rings, such as the inner top strap ring, contacts a given anode vane, its correspondent concentric lower ring, such as the inner bottom ring in this example, does not contact the same anode vane This is referred to as an asymmetric type strap ring configuration.

The cathode is at the center of the resonant anode cavities in a magnetron. The cathode is generally heated. As such, the cathode and the heater contained therein receive a feed from a correspondent lead line. The cathode-heater lead may have a pair of metal plates that block the EM leakage, to some degree, but the performance thereof is far from satisfactory. More systematic measurement, and a completely new design, is needed to achieve the desired level of blocking EM leakage.

At the end of the cathode assembly, a filter circuit is generally installed and enclosed in a shield box. However, the filter circuit is effective only for low frequency noise, and not for the high frequency component typical in EM leakage. The shield box is generally press fitted to the cathode assembly, and the shielding effect on the main microwave frequency leakage is dubious at best.

In the 4G magnetron disclosed hereinbelow by the inventor hereof, a dispenser cathode is used. The dispenser cathode runs at very low temperature (~950 C), and the active material, i.e. the barium, is continuously dispensed from within the tungsten matrix structure. The dispenser cathode may run at a much lower temperature than known magnetrons, and as such may offer very long life.

However, a dispenser cathode that provides such a long lifetime needs to operate in an UHV (Ultra High Vacuum) environment, such as on the order of 10-8 Torr or below. In order to achieve such a condition, one must exercise a great care in fabricating and processing the 4G magnetron. Furthermore, the dispenser cathode requires an activation process that can only be checked by an emission test.

It presents a challenge to carry out processes to create a 4G magnetron under mass production conditions. The UHV condition can be obtained only with a lengthy vacuum pumping and bakeout process under tightly sealed environment. Therefore, a continuous process to create a 4G magnetron is impractical and a batch job process is generally required. Moreover, because the 4G magnetron uses a different cathode from the 3G magnetron, and consequently the processing technologies used for the 3G magnetron are not helpful in designing processing systems for a 4G magnetron Therefore, the need exists for improvement in the overall performance, EM leakage, temperature control, and processing of a magnetron.

SUMMARY

The present invention is and includes a magnetron. The magnetron may include an anode, comprising a cylindrical member and anode vanes disposed within the cylindrical member which define resonant cavities therebetween, and a dispenser cathode, suitable for heating and located coaxially within said anode.

The magnetron may operate in a temperature range of about 850-1050 C. Accordingly, the magnetron of the invention may have a cathode lifetime of about 160,000 hours. The dispenser cathode may comprise an active barium cathode.

The invention may include conduction cooling for tips of the anode vanes proximate to the dispenser cathode. Further, the heating of the cathode may comprise an indirect heating. The presently inventive magnetron may also include a plurality of strap rings concentrically secured about ones of the anode vanes to thereby minimize produced electromagnetic leakage power, each of the concentric strap rings forming top and bottom strap ring portions that are symmetric with respect to one another.

Moreover, the dispenser cathode may include a first hollow cylindrical shell enclosing a heater filament brazed on a first end, and joined at a second end to a first line; and a second hollow cylindrical shell that at least partially encloses the first hollow cylindrical shell, wherein the second hollow cylindrical shell provides a vacuum envelop that eliminates electromagnetic leakage power from the first line. Yet further, ones of the magnets that create the magnetic fields may comprise high residual magnets having strong coercive force, such as magnets comprising one of SmCo and NdFe.

Additionally, an apparatus for cooling a magnetron by thermal conduction alone is disclosed. The apparatus comprises an anode with an outside wall having a central portion that conducts heat to the atmosphere through components having high thermal conductivity, and upper and lower portions having low thermal conductivity that insulate the magnetron magnets from the heat.

The present invention also is and includes a unique anode structure for a magnetron. The anode structure includes a cylindrical anode which defines a plurality of microwave resonant cavities, wherein each of the plurality of microwave resonant cavities is bounded by a respective portion of a cylindrical anode and two radially disposed anode vanes, and wherein the plurality of microwave resonant cavities are radially disposed from an perpendicular axis about a center cathode suitable for heating; and a plurality of strap rings concentrically secured about ones of the anode vanes to thereby minimize produced electromagnetic leakage power, each of the concentric strap rings forming top and bottom strap ring portions that are symmetric with respect to one another.

The present invention may additionally include a cathode structure for a magnetron. The cathode structure may include a first hollow cylindrical shell enclosing a heater filament brazed on a first end, and joined at a second end to a first line; and a second hollow cylindrical shell that at least partially encloses said first hollow cylindrical shell, wherein the second hollow cylindrical shell provides a vacuum envelop that eliminates electromagnetic leakage power from the first line.

Yet further included in the present invention is a method for preparing a plurality of magnetron tubes substantially simultaneously. The method includes the steps of assembling a plurality of magnetron tubes, each comprised of at least a cathode and an anode block comprised of a plurality of chambers formed of an anode cylinder enclosing a plurality of laterally extending anode vanes, on a processing tray in a clean room; processing ones of the magnetron tubes on the processing tray in an ultra high vacuum (UHV) during a batch job within a processing chamber having at least three compartments; differentially pumping the at least three compartments; enclosing the processing chamber with a heating block; and baking out the processing chamber in the heating block at about 300 C for an extended time period. The method may further include cooling the process chamber by fan forced air; activating ones of the cathodes by heating to about 1100 C using current supplied to the ones of the cathodes; and pinching off the magnetron tubes.

The processing tray may be about 3 m long and may hold 50 magnetron tubes. The processing tray may comprise four bus-bars, which supply heater current and cathode current to the cathode, anode current to the anode block, and a temperature monitoring current. The heating the cathodes may include heating to about 950 C, and the method may further include measuring emissions from the ones of the cathodes during the heating to about 950 C. The pinching step may comprise pinching by hydraulic knives. The method may further include purging the processing chamber with dry nitrogen. Additionally, a plurality of ones of the processing chambers may be arrayed to enhance throughput.

Thus, the present invention provides improvement in the overall performance, EM leakage, temperature control, and processing of a magnetron.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate disclosed embodiments and/or aspects and, together with the description, serve to explain the principles of the invention, the scope of which is determined by the claims.

In the drawings:

FIG. 1 illustrates a magnetron;

FIG. 2 illustrates an exemplary 4G magnetron;

FIG. 4A illustrates a strap ring configuration for a magnetron;

FIG. 4B illustrates a symmetric strap ring configuration for a magnetron;

FIG. 4C illustrates an asymmetric strap ring configuration for a magnetron;

FIG. 5A illustrates power efficiency of a symmetric and an assymetric strap ring configuration;

FIG. 5B illustrates leakage power of a symmetric and an assymetric strap ring configuration;

FIG. 6A illustrates an embodiment of a cathode choke;

FIG. 6B illustrates an embodiment of a cathode choke;

FIG. 6C illustrates an embodiment of a cathode choke;

FIG. 6D illustrates an embodiment of a cathode choke;

FIG. 7 illustrates a low profile magnetron;

FIG. 12 illustrates wedge type magnetron anode vanes;

FIG. 13 shows an exemplary fully assembled sulfur lamp apparatus comprising a microwave assembly including a magnetron in a case configured to provide conductive cooling, coupled to a lamp assembly containing a sulfur bulb, in accordance with the disclosure;

FIG. 18 illustrates a magnetron employing pump strips;

FIG. 19 illustrates a pumping port for a magnetron;

FIG. 20 illustrates a magnetron having three sub-assemblies;

FIG. 21A illustrates a bifurcated, rectangular magnet assembly;

FIG. 21B illustrates a bifurcated, chamfered magnet assembly;

FIG. 23 illustrates heat flow in a 4G magnetron;

FIG. 24 illustrates a magnetron having cooling plates and cathode shield covers;

FIG. 26 illustrates a magnetron tube;

FIG. 27A illustrates an exemplary magnetron tube processing tray;

FIG. 27B illustrates a processing tray, and bus-bars thereof;

FIG. 27C illustrates a plurality of magnetrons on a processing tray;

FIG. 29B illustrates a front end of a processing chamber;

FIG. 29C illustrates a rear end of a processing chamber;

FIG. 30 illustrates a plurality of heating and cooling elements for processing a magnetron;

FIG. 31A illustrates pinch off devices for magnetron processing;

DETAILED DESCRIPTION

Figure 3A:
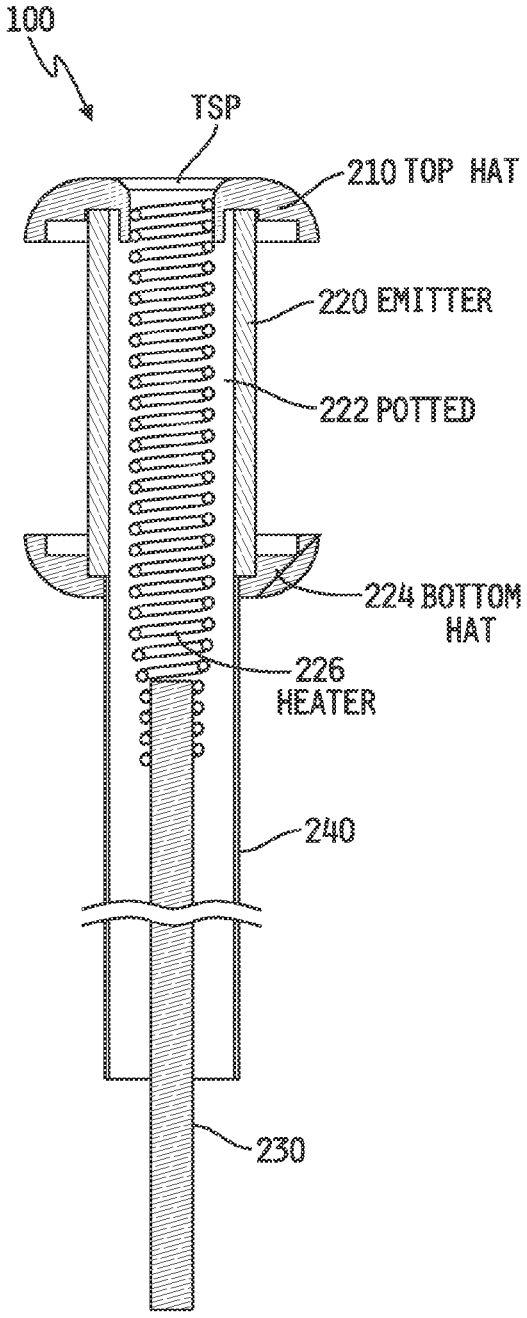
FIG. 3A illustrates a dispenser cathode.

It is to be understood that the figures and descriptions provided herein may have been simplified to illustrate elements that are relevant for a clear understanding of the present invention, while eliminating, for the purpose of clarity, other elements found in typical like apparatuses, systems and methods. Those of ordinary skill in the art may thus recognize that other elements and/or steps may be desirable and/or necessary to implement the devices, systems, and methods described herein. However, because such elements and steps are well known in the art, and because they do not facilitate a better understanding of the present invention, a discussion of such elements and steps may not be provided herein. The present disclosure is deemed to inherently include all such elements, variations, and modifications to the disclosed elements and methods that would be known to those of ordinary skill in the pertinent art.

A magnetron, such as that illustrated in the cross-sectional diagram of FIG. 1, is comprised of an electron tube that produces coherent microwave radiation. In the magnetron 1 as illustrated, electrons traveling from a center cathode 10 to a series of resonant cavities that are, collectively, an anode 12 are set in paths by a magnetic field created by a multiple permanent magnets 14. The circular component of the electrons' motion causes microwave-frequency oscillations in the voltage induced in the resonating cavities 14 comprising the anode, and the anode is connected to an antenna 16 that emits the microwaves. Magnetrons have a great number of applications, including radar, microwave ovens, lighting applications, etc.

More specifically, electrons leave the cathode 10 and are accelerated toward the anode vanes 18, which comprise the walls of the resonant cavities referenced herein throughout, due an established electric field. The presence of a strong magnetic field in the chamber, or cavity, between cathode and anode produces a force on each electron which is mutually perpendicular to the electric field and the electron velocity vectors, thereby causing the electrons to spiral away from the cathode in paths of varying curvature. As this cloud of electrons approaches the anode, it falls under the influence of the fields at the anode vane tips, and electrons will either be retarded in velocity, if they face an opposing field, or accelerated, if they are in the vicinity of an aiding field.

The result is a collection of electron "spokes" as the cloud nears the anode, with each spoke located at a resonator having an opposing field. On the next half cycle of oscillation, the field pattern will have reversed polarity and the spoke pattern will rotate to maintain its presence in an opposing field. This synchronism between the electron spoke pattern and the field polarity in a crossed field device allows a magnetron to maintain relatively stable operation over a wide range of applied input parameters.

An exemplary embodiment of the instant invention, the "4G Magnetron", is illustratively provided in FIG. 2. The 4G magnetron may be used for known prior applications, such as for microwaves, radar, and the like, and additionally, for example, to drive a sulfur lamp in street lighting applications.

1. Dispenser Cathode

The dispenser cathode 100 of the 4G magnetron may provide a long lifetime, such as over 100,000 hours. Further, the cooling system 120 may be entirely conductive and convective, that is, the cooling fan typical in a 3G magnetron may be eliminated. Moreover, the anode resonator chamber 140 may be designed with low profile so that the very thin magnets, such as SmCo or NdFe magnets, may be used. Additionally, the magnets may be maintained at cooler temperatures because they are almost completely isolated from the heat generated by the cathode 100, due to the design of the anode chamber 140.

More particularly, the 4G magnetron discussed herein may provide a lengthy lifetime, such as 100,000 hours, 160,000 hours, or more. The power for the 4G magnetron may be at a decreased level as compared to the 3G magnetron, such as in the range of about 250-400 W, and conduction may be employed in the 4G magnetron, such that no cooling fan motor or other moving parts are necessitated.

Additionally, as referenced throughout, the 4G magnetron may employ the afore-discussed dispenser cathode, such as with an internal heating coil, and may have an operating temperature around 950 C, such as in the range of about 850 C to about 1050 C. The decreased temperature, anode chamber design, and conductive cooling system of the present invention may allow for the use of thin magnets to generate a field in the 4G magnetron, such as SmCo and/or NdFe magnets. Yet further, the 4G magnetron may employ cathode side pumping (NEG/Ti), and may be pinched off.

FIG. 3 illustrates an exemplary dispenser cathode 100, which may be provided in the instant invention instead of the known tungsten filament cathode. The dispenser cathode 100 runs at a much lower temperature than the known tungsten filament cathode, and thus provides a much longer lifetime. Most high power tubes, such as the klystron, typically run at least 1,050 C, with a lifetime of 40,000 hours. It is well understood by skilled artisans that cathode lifetime doubles as the operating temperature is decreased by each 50 C increment.

As shown, the dispenser cathode may comprise a top hat 210, an emitter 220, a potted 222, a bottom hat 224, and a heater 226. Further, the heater may receive power from a lead line 230. Benefits to using the dispenser cathode, which may be, for example, an active barium cathode, include running at low temperature, which, of course, also lowers required heating power and the correspondent cooling burden. Since the cathode radiates heat proportional to the fourth power of the operating temperature, the heater power loss by radiation, when it runs at 950 C, is only 12% of the radiation loss for a cathode running at 1,800 C.

More particularly, overall heater power required, including conduction loss through the leads, may be less than 10

W using the dispenser cathode, as compared to 40 W with a tungsten filament cathode. The savings of 30 W in heater power is equivalent to about 7.5% increase in overall efficiency for a 400 W class magnetron.

The radiated heat from a cathode falls principally on the anode vane tips 18, which face the cathode in close proximity. The thermal loading at the vane tips due to the cathode heat radiation for a dispenser cathode is only 12% of that for the tungsten filament cathode. This substantial reduction in thermal loading makes it easier to employ a magnetron cooling system by conduction, such as without using cooling fans.

Additionally, the dispenser cathode may be an indirectly heated type with a separate heater 226. The emitter may be a hollow cylindrical shell 240 with the heater filament inserted inside. The one end of the heater filament may be attached the top hat 210 of the cathode. The other end may be connected to a lead wire 230, such as a molybdenum heater lead wire, which may be shielded by the cathode lead in the shape of a thin shell. The reason for this type of shielding structure is to prevent arcing and to block EM leakage. This configuration is discussed with more particularity hereinbelow.

2. Strap Rings

In a magnetron, the strap rings (shown as 150 in FIG. 1), more particularly illustrated in FIG. 4A, play an important role to enable the magnetron to operate stably and with high efficiency. A feature of the anode for the 4G magnetron may include that symmetric strap rings (SSR) 150, illustrated in FIG. 4B, are used in contrast to the asymmetric strap rings (ASR) (FIG. 4C) generally used in a 3G magnetron. The power efficiency for the SSR is higher than that of the ASR, as shown graphically in FIG. 5A. The efficiency for the SSR reaches 89%, which is the highest efficiency for a magnetron in this frequency region.

The leakage power toward the cathode end is shown graphically in FIG. 5B. Previously, in the 3G magnetron, the lead structure is rather complex and a substantial leakage comes through this route. In the 3G magnetron, although the cathode end is covered with a filter circuit inside, the shielding is insufficient. Of course, this leakage level is not acceptable for certain applications, such as lighting applications, where much stricter regulations are applied. Using SSR in the 4G magnetron, the leakage level is one tenth of that present using ASR in the 3G magnetron.

More specifically, and as illustrated in the cross-sectional diagram of FIGS. 2, 4B and 4C, the anode vanes 18 are radially disposed from a cylindrical outer anode structure 22. This anode structure defines a plurality of microwave resonant cavities, wherein each of the plurality of microwave resonant cavities is bounded by a respective portion of a cylindrical anode 22 and two radially disposed anode vanes 18. Each of the anode vanes 18 further typically includes thereabout concentric strap ring 150 pairs, atop and below each anode vane 18, each concentric pair (above and below the anode vanes) thus forming top 150*a* and bottom strap ring 150*b* pairs. The strap rings 150 in a magnetron separate the competing modes from the main operating mode, and thus enhance the stability and efficiency of operation. Known strap rings 150 also induce an asymmetric field distribution both in the angular direction along with the rotating electron beam, and in the axial direction along the cathode. As such, in the existing art, it is typical that the top and bottom strap rings are asymmetrically contacted with each anode vane with regard to one another, as is illustrated with particularity in FIG. 4C. More specifically, the asymmetry of the anode vane contact in the strap rings 150 shown in FIG. 4C has been previously understood to average out undesirable produced leakage/noise by alternating the contact of a one of the top pair rings with its corresponded one of the bottom pair of the strap rings.

FIG. 4B is a cross-sectional illustration of an anode configuration comprising symmetrically contacted top 150*a* and bottom 150*b* strap ring pairs. In this symmetric strap ring configuration, the power efficiency is comparable to or even bigger than the asymmetric strap configuration, as shown graphically in FIG. 5A.

Moreover, the symmetric strap ring configuration generates much less leakage power toward the cathode than the asymmetric configuration, as shown in FIG. 5B. The reason for this decrease in leakage power is that the asymmetric strap ring configuration also introduces an asymmetric field distribution along the axis of the cathode.

As mentioned, in a magnetron, the cathode may act as an antenna to pick up microwave power generated in the space between the cathode and the anode vanes. The field strength along the cathode surface remains nearly constant for the symmetric strap ring configuration disclosed herein and shown in FIG. 4C, while it varies for the asymmetric strap ring configuration. The variance along the cathode surface in an asymmetric configuration induces a coaxial mode that is transmitted along the cathode and leaked out toward the cathode end. Thus, leakage power is appreciably eliminated by employing the present symmetric strap ring configuration.

3. Cathode Choke

Figure 3B:
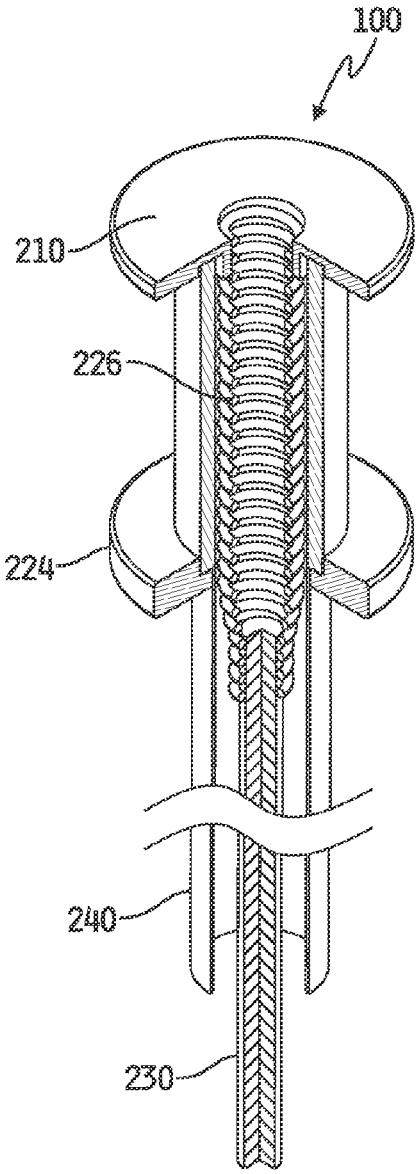
FIG. 3B illustrates a coaxial form for a cathode lead.

In order to further reduce leakage power, the cathode leads may be made in a coaxial line form, such as is shown in FIGS. 3A and 3B. Further, choke structures may be included in the cathode structure. For example, four different configurations of exemplary choke structures are shown in FIGS. 6A, 6B, 6C and 6D. The choke structures 310 may be mounted to the inside structure of the cathode that support the lead line 230, or may be mounted to the outer wall of the cylinder 240 containing the heating element. Any one of the choke structure blocks the leakage down to at least the level of −35 dB. In short, the SSR configuration with a cathode choke may minimize leakage to −45 dB below the ASR configuration without a choke. Additional leakage power and low frequency noise may absorbed by a filter circuit that is contained by a shielded filter cover 350.

For certain applications, such as lighting applications, the magnetron should preferably be as compact as possible. A compact magnetron may include a low profile magnetron cavity, i.e., an anode chamber 140, as shown in FIG. 7, with which thin magnets may be used (as shown in FIG. 2) to further minimize the profile. A cathode choke may additionally limit leakage for this minimized profile design.

More specifically, the present invention may thus further include an inventive cathode structure 100 for a magnetron 1, as illustrated in the cross-sectional view of FIG. 3B. As shown with reference to FIG. 3B, the cathode structure 100 may include a cathode lead in the form of a first hollow cylindrical shell 240 (also referred to as a cathode support), wherein the shell 240 encloses the heater lead 230 for the heater filament 226. The cathode structure 100 further comprises a top hat 210 on an end of the cathode 100 opposing the shell 240, and a bottom hat 224 at the uppermost portion of the shell 240. Thereby, a coaxial line is formed to alleviate noise and leakage, with the cathode structure 100 as the center conductor of that coaxially line.

Unshielded, the exposed parts of the heater lead 230, and/or the cathode lead 240, may pick up microwaves inside the magnetron and transmit those microwaves along the cathode 100. Consequently, in this present invention, the cathode lead may be replaced by the thin hollow cylindrical shell 240. By further shielding at least some of the lower portion of the cathode with a second cylindrical shell 245, the likelihood that the lead lines 230, 240 may act as antennas for leakage power is at least substantially eliminated. In short, in this embodiment further illustrated in FIGS. 6A, 6B, 6C and 6D, the cathode 100 forms a coaxial conductor within a coaxial line further comprised of the vacuum envelop formed between shell 240 and shell 245.

Figure 8:
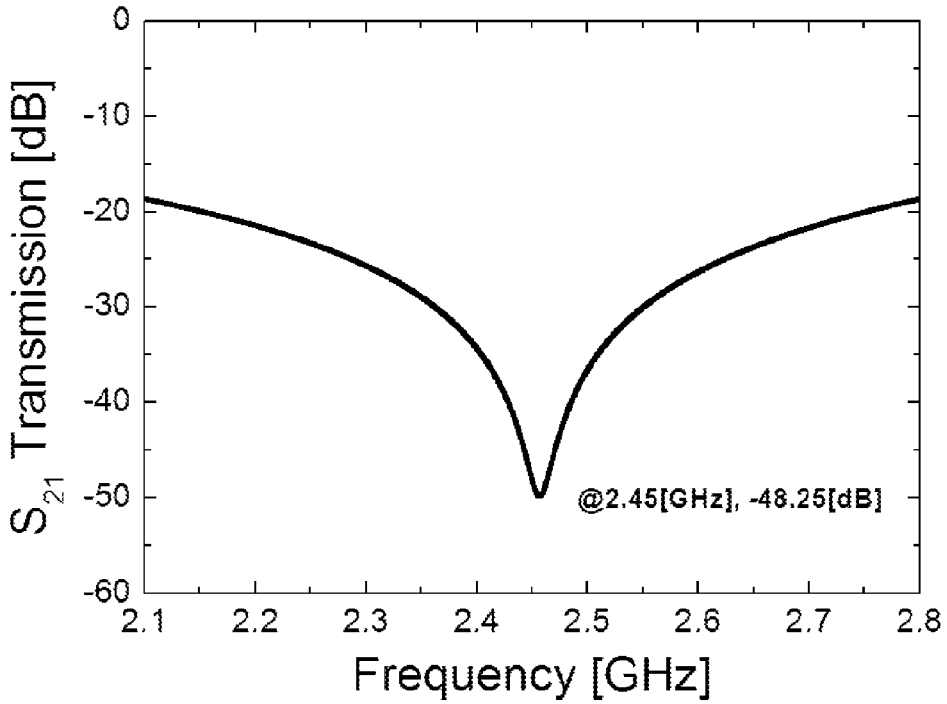
FIG. 8 is a graphical illustration of shielding effects of the cathode choke.
Figure 9:
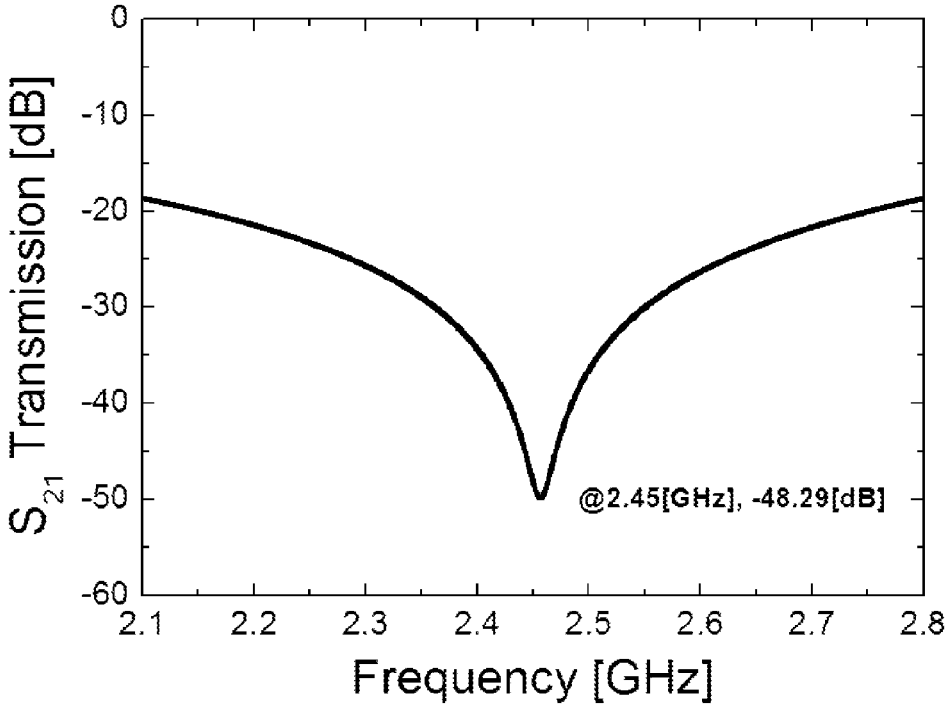
FIG. 9 is a graphical illustration of shielding effects of the cathode choke.

Additionally, within cylindrical shell 245 a cathode "choke" structure may be provided. By way of example, two types of cathode chokes are illustrated in FIGS. 6A and 6B, and in FIGS. 6C and 6D, respectively. Illustratively, a choke structure 135 may be provided on the outer wall of inner shell 240, as shown in FIGS. 6A and 6B. FIGS. 6A and 6B differ in the proximity of the support for the cathode choke 135 to the bottom hat 224. The shielding effects of the configurations in FIGS. 6A and 6B are illustrated graphically in FIGS. 8 and 9, respectively.

Figure 10:
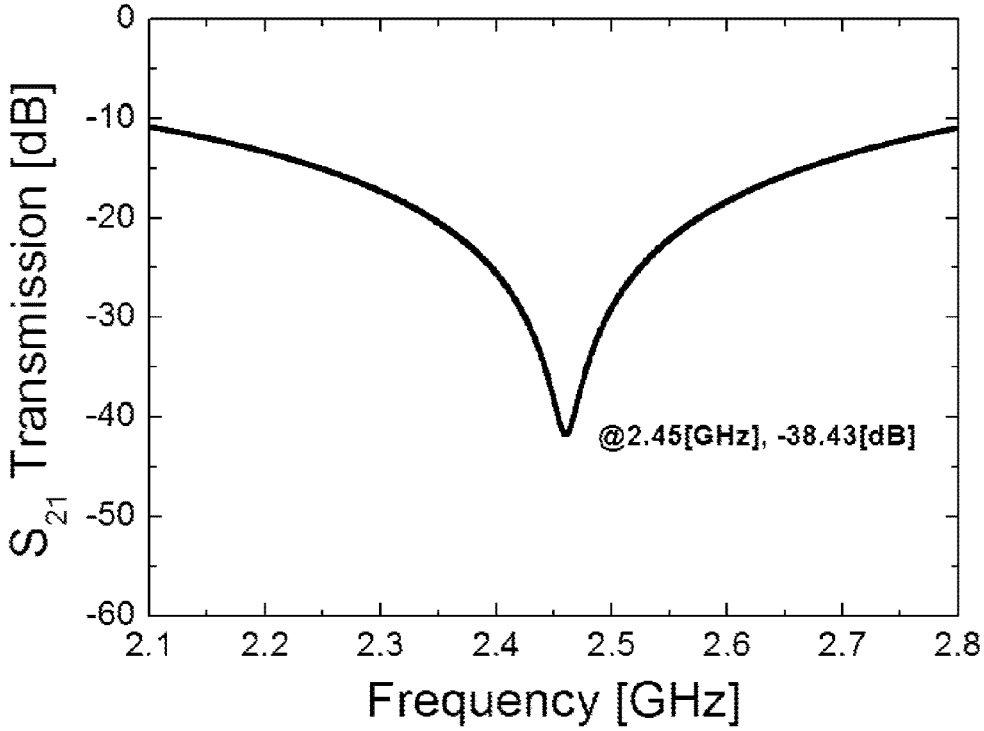
FIG. 10 is a graphical illustration of shielding effects of the cathode choke.
Figure 11:
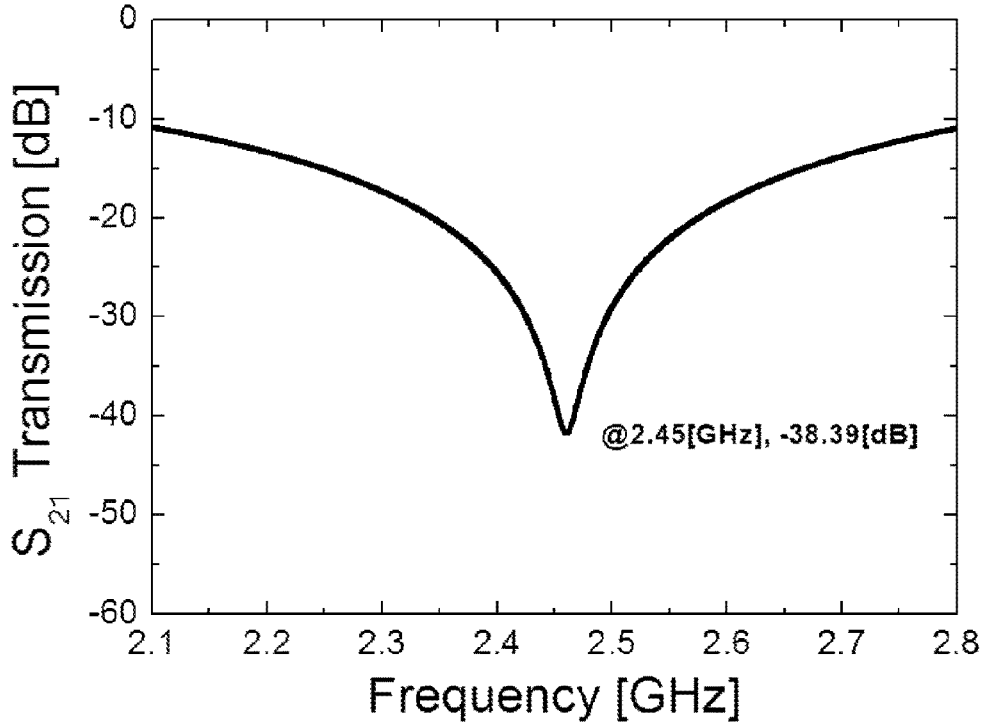
FIG. 11 is a graphical illustration of shielding effects of the cathode choke.

The choke structure 135 on the inner wall of outer shell 245 is shown in FIGS. 6C and 6D. FIGS. 6C and 6D again differ in the proximity of the support for the cathode choke 135 to the bottom hat 224. The shielding effects of the configurations in FIGS. 6C and 6D are illustrated graphically in FIGS. 10 and 11, respectively.

4. Cooling

In an additional exemplary embodiment illustrated in FIG. 12, the anode vanes 410 may be wedge shaped, such as to improve the cooling conductance. The wedge shaped vane tips have thicker heads to help increase beam impedance for better efficiency. Coupled with the symmetric strap ring configuration, the 4G magnetron may demonstrate up to 89% conversion efficiency from beam power to microwave power. The symmetric strap rings also reduce the leakage power toward cathode end down to the one tenth level as compared to the asymmetric strap tings.

Moreover, with respect to cooling of the magnetron, FIG. 13 shows an illustrative embodiment of a fully assembled lamp apparatus comprising a magnetron that produces microwaves operatively coupled to a bulb. The magnetron is disposed in enclosure 181 and thus is not visible in the figure. As discussed throughout, the magnetron has an anode with resonant cavities formed by an internal anode structure, i.e., vanes, in conjunction with a central portion of an outside wall, all formed of a first highly electrically conductive material such as copper. The vanes are heated during the process of producing microwaves. The heat may be dispersed to the surrounding atmosphere as quickly as possible via conduction alone, that is, without using a motorized fan.

Figure 14:
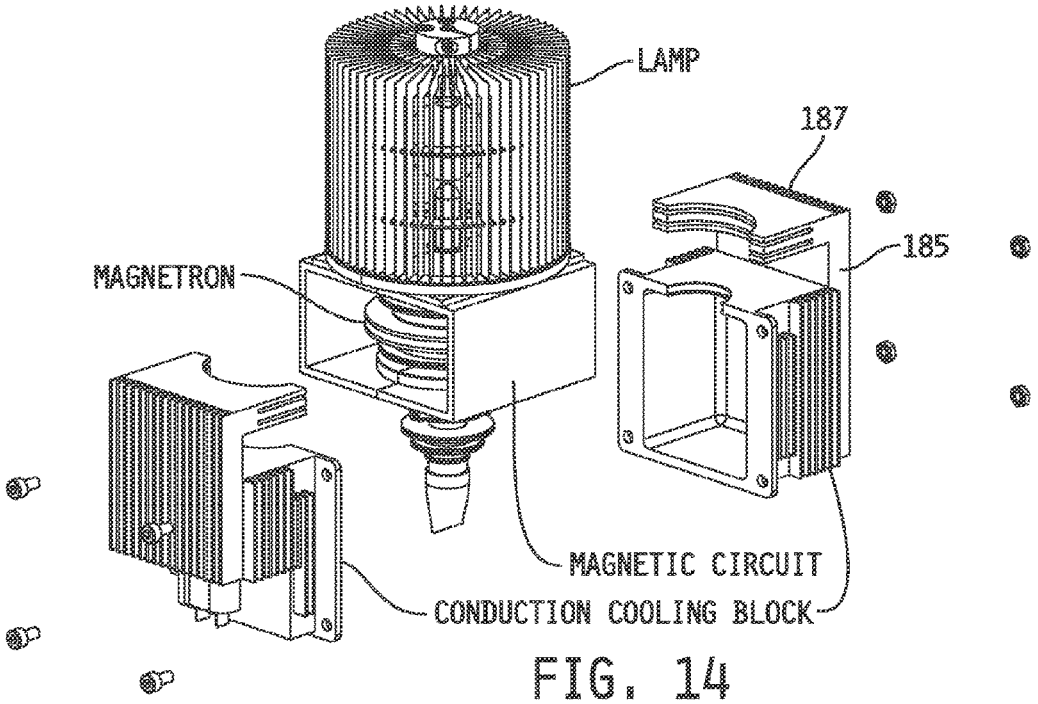
FIG. 14 shows an exploded view of the apparatus of FIG. 13, that shows a conduction cooling block assembly comprising cooling fins, cooling plates with deep exterior grooves and an integrated cathode shield cover portion, in accordance with the disclosure.
Figure 15:
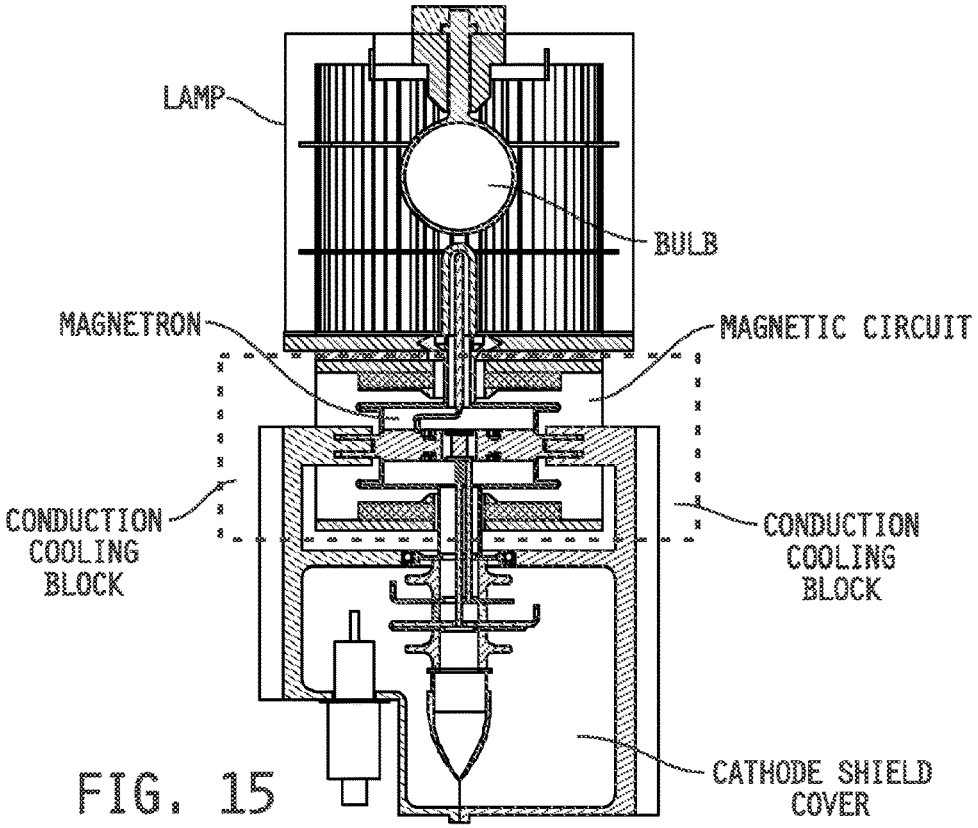
FIG. 15 is a cutout view of the disclosed conduction cooling apparatus.
Figure 16:
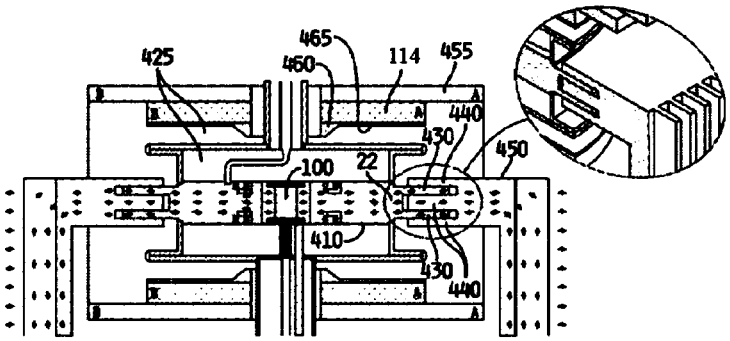
FIG. 16 illustrates the path of heat flow from the cathode to the anode vane tips, through a series of coupled high thermal conductivity elements, to be dissipated in the atmosphere, in accordance with the disclosure.

FIG. 14 shows an exploded view of the apparatus of FIG. 13. FIG. 14 shows a conduction cooling block assembly comprising cooling fins, cooling plates 185, and deep exterior grooves 187 in the cooling plates. FIG. 15 is a cutout view of the apparatus of FIG. 14, and more clearly showing the components and structure of the lamp apparatus. FIG. 16 is a magnified view of the portion of FIG. 15 contained in the dotted box, and illustrates the flow of heat through the apparatus from the cathode of the magnetron to the atmosphere.

As shown in FIG. 16, cathode 100, which is heated to produce a cloud of electrons, imparts heat to the anode 410, due both to its high temperature, and by providing electrons that flow as current through the anode that also heats the anode. In general, the anode is made of a block of copper, preferably so-called Oxygen-free high thermal conductivity (OFHC) copper, that readily conducts heat.

In a preferred embodiment, the side wall of the anode is constructed with only a central portion 22 made of the same material as the internal structure of the anode, but with top and bottom portions above and below the central portion, respectively, made of a material that is a poor thermal conductor, such as stainless steel. Thus, heat is passed readily through the central portion of the outside wall, but not through the top and bottom portions. The top and bottom portions proceed, or are thermally coupled to other poor thermal conducting elements such as air gaps 425 that proceed, toward the magnets without conducting an undue amount of heat to the magnets.

In an embodiment, thick cooling fins 430 comprising or made of a material having a high thermal conductivity, such as OFHC copper, are fixedly coupled to the central portion of the anode outer wall, and conduct away the large majority of the heat that has passed through the anode. The heat is conveyed through the thick copper cooling fins, and transferred to one or more thick cooling fins 440 comprising or made of a second material having a high thermal conductivity, such as aluminum. The aluminum cooling fins are interleaved with and slidingly fitted to the copper cooling fins to allow relative sliding motion between them. However, in order to achieve an efficient heat transfer from the copper fins to the aluminum fins, the copper and aluminum fins are arranged to have a large overlap area. Preferably no thermal epoxy is used to couple the copper and aluminum fins together, because the epoxy may decay and degrade over the long lifetime needed in lighting applications. Moreover, because the aluminum cooling fins are not rigidly attached to the copper cooling fins, undesirable mechanical stress on the magnetron wall is avoided that could otherwise arise due to thermal expansion and contraction of the high thermal conductivity elements through which the heat is passing.

In an embodiment, the heat conducted to the aluminum cooling fins is conducted through a cooling block coupled to or integral with the aluminum cooling fins. At an exterior surface of the cooling block, the heat is conducted to the atmosphere. In an embodiment, the exterior surface of the cooling block is configured with grooves or fins to increase the surface area of the block in contact with the atmosphere, and therefore the ability to conduct heat away from the cooling block to the atmosphere.

As shown in FIG. 15, in an embodiment the cooling block may be coupled to or integrated with a cathode shield cover. The cooling block and the cathode shield cover may both be made of a material with good heat conductivity such as aluminum, and both may also have a plurality of external grooves or fins to increase their external surface area. The grooves on the cooling block and the cathode shield cover are configured to provide a large surface area in contact with the surrounding atmosphere, to disperse the heat drawn away from the magnetron anode quickly to the atmosphere without need for a fan to provide forced air flow as in the prior art.

In addition, heat should be kept away from the magnets as much as possible because a rise in the temperature of the magnets results in a drop in their magnetic field, and the magnetron operation is quite sensitive to such changes in the magnetic field. Thermal isolation of the magnets from the heat of the anode is provided in part by the anode outside wall comprising and top and bottom portions made of a material having a lower thermal conductivity than the central portion, such as stainless steel. Top and the bottom anode covers may also be inserted between the anode and the magnets, made of the same or a different low thermal conductivity material, such as thin stainless steel plates which are a very poor heat conductor. The magnetron magnets may then be placed in fairly close proximity to the top and bottom covers of the anode and remain fairly well isolated from the heat generated by operation of the magnetron.

In an embodiment, the top and the bottom anode covers may be held in place within the magnetic circuit visible in FIG. 14. Referring also to FIG. 16, the magnetic circuit comprises at least two magnets 114, each one comprising first and second magnet halves A, B, all of which are configured when the magnetic circuit is assembled to generate a magnetic field that provides or supports the magnetic field of the magnetron. The two magnet half pairs A and B are fixedly attached to a respective half A or B of the magnetic flux return 455. Pole piece halves are fixedly attached to a respective magnet half. Each pole piece half is configured to have a frustoconical portion 460 and a thin portion 465 extending therefrom near or to the edge of the magnet to which it is attached. The pole pieces are configured to concentrate the magnetic field produced by the magnets toward the central cavity of the magnetron anode through which the electrons ejected from the cathode must pass, The magnets, pole pieces, and flux returns, when assembled, form a magnetic circuit in which the magnetic flux path encloses the anode and its top and bottom covers.

As shown in FIGS. 14 and 16, in an embodiment there are two assembled magnets and two assembled pole pieces, each magnet and pole piece formed from respective half pieces. An external surface of one of the pole pieces may be fixedly attached to a base of a sulfur lamp assembly and removably coupled to the conductive cooling block of a sulfur lamp apparatus. The lamp base remains acceptably close to the atmospheric temperature because the lamp cage has a large surface area to dissipate heat.

5. Antenna

Figure 17:
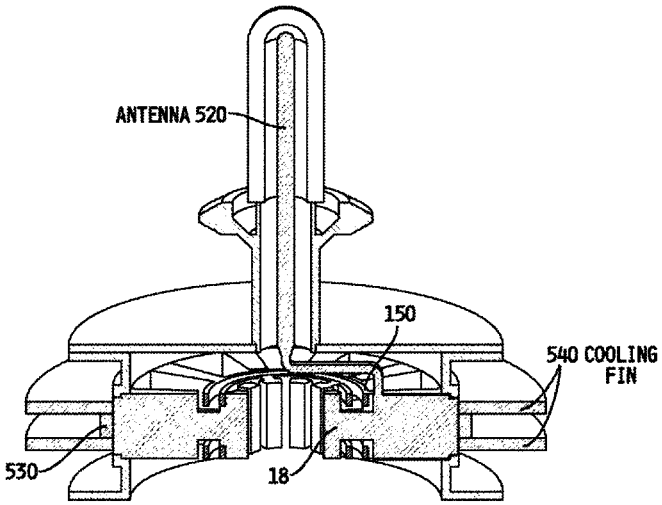
FIG. 17 illustrates an embodiment of a magnetron antenna.

An exemplary antenna 520, as shown in FIG. 17, may be a voltage coupled type that is attached to one vane 18 just outside the outer strap ring 150. The exemplary antenna may sharply bend toward the center, and may be again sharply bent toward the top. The antenna rod may further be at least partially covered by a thin ceramic window.

6. Formation

Further, as illustrated in FIG. 17, the anode block 530 may be of a unibody type, such as may be formed of OFHC copper by extrusion or brazing. The side wall of the anode block 530 may constitute the middle section of the side wall of the magnetron resonator. On the outer surface of the anode block, one or more cooling fins 540, which may preferably be thick, may be attached and/or otherwise joined to the aluminum cooling fins, such as by a sliding fit method.

Further, the magnetron resonator side wall may be a hybrid type, such as shown in the example of FIG. 7, in which the top and the bottom sections are made of thin stainless steel cylinders. This configuration cuts down the heat flow toward the magnets. The top and the bottom covers of the resonator may also be made of thin stainless steel, and may isolate the magnet fairly well from the heat sources that are located near the anode tips.

A dispenser cathode may require a much higher degree of vacuum than the tungsten filament cathode. An ultra high vacuum (UHV), on the order of 10-9 Torr, may be achieved by judicious choice of the material to be used, and by particular fabrication methods and cleaning processes.

However, even after a thorough high temperature bakeout with external pumping, it is not possible to eliminate outgassing completely. In order to absorb out gassing after pinching off from the external pumping, NEG (Non-Evaporating Getter) pump strips 610 and TSP (Titanium Sublimation Pump) may be employed. The NEG strips may be laser welded at the bottom cover of the magnetron, and the TSP may be placed on the top of the cathode hat 210, as shown in the exemplary embodiment of FIG. 18.

A pumping port 710 for the 4G magnetron, as illustrated in FIG. 19, may be located at the cathode end. This configuration may be chosen particularly for ease of the fabrication The 4G magnetron may be formed of three subassemblies, as shown in the exemplary embodiment of FIG. 20, such as for ease of fabrication. These three subassemblies may be: the anode assembly 820; the cathode assembly 830; and the top cover/antenna assembly 810. These three subassemblies may be joined together by welding at welding joints 840 provided.

The anode assembly 820 comprises the main body of the magnetron resonator, and may be made in three sections: the anode block 822, the upper side wall 824 and the lower side wall 826. The anode block 822 may include the anode vanes 18, strap rings 150, the antenna 16/520, the middle section of the side wall and the cooling fins. These parts may be formed of OFHC copper and assembled together by, for example, a brazing method. The anode vanes can be made by EDM or by extrusion and EFM combination, by way of non-limiting example.

The upper 824 and lower section 826 of the side wall may be made of thin stainless steel cylinder and brazed onto the anode block, such as at the same time with anode block parts. After the anode assembly 820 is made, the resonance frequency can be measured, such as by a cold test method, and may be tuned, such as to 2.45 GHz, such as by deforming the strap rings.

As discussed above, in the 4G magnetron the dispenser cathode may have a long lifetime, the price for which is the UHV vacuum, which requires very careful processing of the cathode assembly 830. The dispenser cathode may be an indirectly heated type, with the heater filament embedded within the hollow cylindrical shell type emitter, such as is discussed herein. One end of the heater filament may be fixed to the top hat of the cathode and the other end may come out from the hole at the bottom hat of the cathode. The cathode support lead and the heater lead inside may be connected to terminals that are properly insulated, such as with alumina ceramics. These terminals may be made of kovar with a low thermal expansion coefficient, and may be brazed on the alumina ceramic rings for vacuum tight sealing. The tube may also be attached to the last ceramic ring for the vacuum pumping port. After a thorough bake-out and activation of the NEG and the cathode, the pumping port may be pinched off for final vacuum sealing.

The antenna assembly 810 may include a long tube ended with a thin ceramic dome. When this antenna is placed and welded onto the anode assembly, this tube and the antenna form a coaxial line to transmit the microwave output. The antenna ends inside the dome and radiates the microwave through the dome ceramic. The dome ceramic thus plays the role of microwave window and provides the vacuum tight sealing.

The burden to generate the required magnetic field in the beam-RF interaction region is greatly reduced with a low profile resonator, as discussed above. Since compact size and light weight are important for certain applications, such as lighting applications, the magnets 114 may be as thin as possible. For the magnet to be thin, the magnet preferably has a high residual magnetism and strong coercive force, conditions which are met by at least SmCo and NdFe magnets. Further, for outdoor applications, a low temperature coefficient may be preferred, in part because the magnet must endure a large change of temperature with small changes of the magnetic field. Magnets with lower temperature coefficients maintain relatively smaller variations in the magnetic fields, which may improve stability in magnetron operation.

The NdFe magnet is typically less expensive than the SmCo magnet, but the temperature coefficient is greater. The maximum temperature of the NdFe magnet is quite low, and therefore a greater care must be paid to keep it cool. The SmCo is more expensive but can tolerate much harsher conditions in temperature.

The ferrite magnet used in most 3G magnetrons may be a poor candidate for the 4G magnetron, in part because it has low residual magnetism and very high temperature coefficient. The Alnico magnet used in earlier models of the 3G magnetron may also be inadequate for the 4G magnetron, in part because it has very low coercive force even though the temperature coefficient is quite low. A magnet with low coercive force cannot be made thin because it cannot resist the strong demagnetizing force when it is made thin.

Figure 22A:
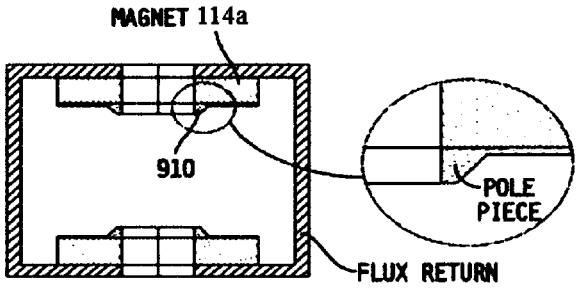
FIG. 22A illustrates an iron pole piece in a magnet assembly.
Figure 22B:
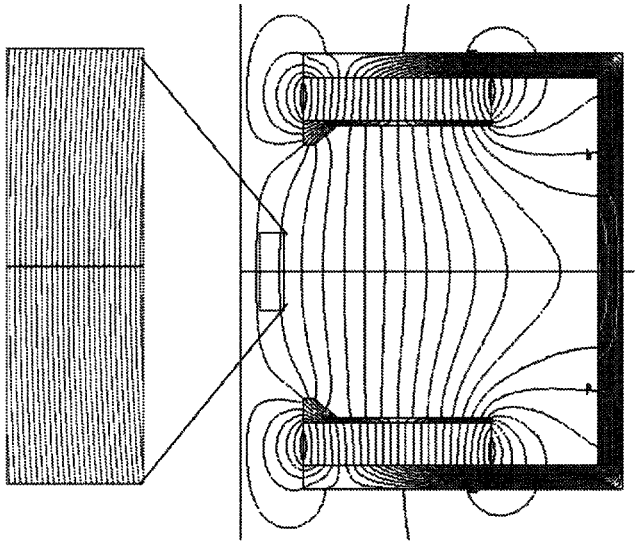
FIG. 22B illustrates the field effect in a magnet assembly.

The at least two magnets, the upper 114*a* and the 114*b*, may be connected together by the magnetic flux return circuit 820 made of soft iron plates or bars. A basic plate 820 is shown in FIG. 21A, and may be modified with a chamfered shape as shown in FIG. 21B. The chamfered type may also be made with iron bars useful to clear the light propagation. Further, on each magnet surface facing to the interaction region, there may be provided an iron pole piece, such as is shown in FIG. 22A, which may be attached to shape the uniform field in the beam-RF interaction region, as is shown in FIG. 22B.

As discussed above, in order to eliminate a cooling fan, a conduction cooling method may be employed. In a magnetron, there are two dominant heat sources: the cathode heater; and the electron beam collected at the anode vane with remaining energy after microwave conversion. Most of the heat from these two sources is on or near the tip area of the vanes. Unless this heat is dissipated properly, too high a temperature may build up, leading to unstable operation or early failure of the magnetron. Two components are particularly sensitive to the high temperature: the strap rings; and the magnet.

To keep the strap ring temperature at a reasonable level, the heat may be removed from the vane tip area, such as to the outside cooling fins, as quickly as possible. For this purpose, wedge shaped vanes may be used to increase the heat conductance outwardly.

In order to maintain the magnet at an acceptable temperature, the magnet may be isolated from the heat conducting path. For this purpose, the magnetron side wall may be of hybrid form, and the middle section may be made of OFHC copper which is continuation of the vane structure. The upper and the lower sections may be made of thin stainless steel cylinders and brazed onto the middle section. These stainless steel sections of the side wall are a very effective means to blocking the heat flow to the magnets. The main path of the heat flow is shown in the example of FIG. 13.

On the outside wall of the middle section, copper cooling fins may be brazed and coupled with aluminum cooling fins, such as by a sliding fit method. The aluminum cooling fins conduct the heat to the cooling plates and the cathode shield covers, with cooling grooves to provide enough cooling surface area, as shown in the illustration of FIG. 24. This conduction cooling system without a cooling fan is sufficiently compact for most applications.

An overall power budget for a 4G magnetron may include: 400 W wall plug power, 30 W (7.5%) lost at the power supply (Inverter Type); 10 W (2.5%) for heater power; 300 W (85%) converted to microwaves; and thus 60 W arrives at the vane tips in the form of waste beam. Assuming that half (5 W) of the heater power goes to the anode vane tips by radiation, and the other half is conducted away though the leads, the total heat loading on the anode vane tips is 65 W, which is a very reasonable range for a compact cooling system provided purely by conduction and without a cooling fan.

Figure 25:
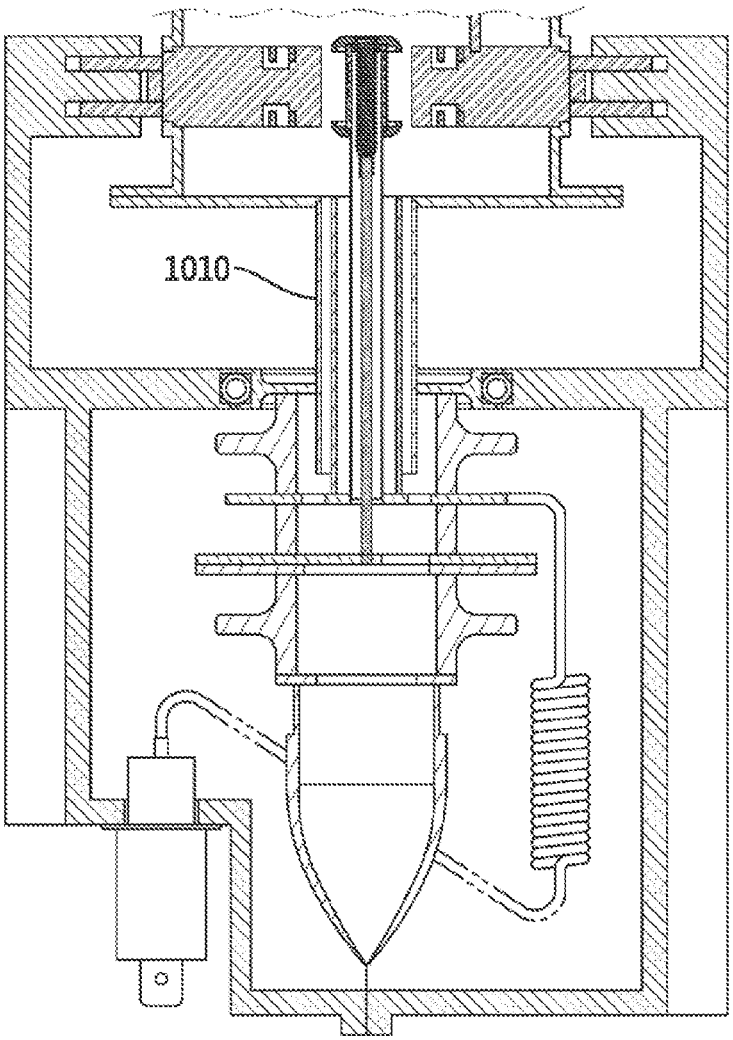
FIG. 25 illustrates a magnetron including a filter box and cooling circuit acting as a part of a cooling plate.

High voltage power may be fed into the cathode, along with the heater power. The feed lines for this power may also provide a conduit for microwave power and other EM noise to leak out. A filter circuit 1010 made of inductors and capacitors may be inserted, and the whole cathode terminal assembly may be enclosed by a shield box to avoid such leakage. Thereby, the only connection to the outside world is through the high voltage capacitors, which are a part of the filter circuit. The filter box may be made of aluminum, such as in one body, with the cooling circuit acting as a part of the cooling plate, as shown in the exemplary embodiment of FIG. 25.

7. Processing

A magnetron tube that produces coherent microwave radiation is illustrated in the cross-sectional diagram of FIG. 26. In the magnetron tube 1 as illustrated, electrons traveling from a center cathode 100 to a series of resonant cavities that are, collectively, an anode 12, are set in paths by a magnetic field created by a multiple permanent magnets.

A so-called "4G" magnetron tube 1, ready for final processing, is shown in FIG. 26. A 4G magnetron may be used for known prior applications, such as for microwaves, radar, and the like, and additionally, for example, to drive a sulfur lamp in street lighting applications. The cooling system of a 4G magnetron may be entirely conductive and convective, that is, the cooling fan typical in a 3G magnetron may be eliminated. Moreover, the anode resonator chamber of a 4G magnetron may be designed with low profile so that very thin magnets, such as SmCo or NdFe magnets, may be used. Additionally, these magnets may be maintained at cooler temperatures because they are almost completely isolated from the heat generated by the cathode, due to the design of the anode chamber 140.

To achieve these and other aspects unique to the 4G magnetron, the final processing of a 4G magnetron tube, such as the magnetron tube shown in FIG. 26, includes vacuum pumping, bake out, cathode activation, emission testing and the pinching off. Due to the use of the dispenser cathode, the foregoing procedures should be carried out under UHV (Ultra High Vacuum) conditions, and may be performed in a processing chamber as a batch job. Furthermore, the processing is preferably economically feasible to allow for use in various high volume applications, such as for street lighting.

In the present invention, economically feasible processing for mass production may be provided using, for example, a processing chamber in which some or all procedures are done in situ, without opening the chamber. For example, a plurality of magnetron tubes ready for processing may be provided on a processing tray, such as in a clean room. An example of such a processing tray 105 is shown in FIG. 27A. An exemplary tray may be, for example, about 3 m long and may hold up to 50 magnetrons, although skilled artisans will appreciate that other tray lengths and/or numbers of magnetrons may be used.

The tray 105 may be provided as having two tiers 107, 109 and the magnetrons may be placed upon the tray(s) as shown in FIG. 27B. The pumping port 111 at the lower part of the magnetron may be installed to pass through two corresponded holes 113, 115 on both decks. The size of the holes may be such that the pumping port fits freely but snugly therewithin.

The tray may also be equipped with four bus-bars, three of which may supply the current for aspects of ones or all of the magnetrons on the tray 105. Two lower bus-bars may supply the heater current 121 and the cathode current 123, and one of the upper ones may supply the anode current 125. The fourth bus-bar 127 may comprise a cable tray carrying a plurality, such as 10, thermocouple gauge wires to monitor one or more magnetron temperatures—for example, one out of every five magnetron tubes may be monitored. The bus-bars may be properly insulated from the tray with alumina ceramics 129. Each of these bus bars may be, by way of non-limiting example, a 0.5" thick and 3 m long copper rod, such as may handle all heater power for the 50 magnetrons upon the tray. The bus bars may be insulated by alumina tubes from supports 135.

Figure 27D:
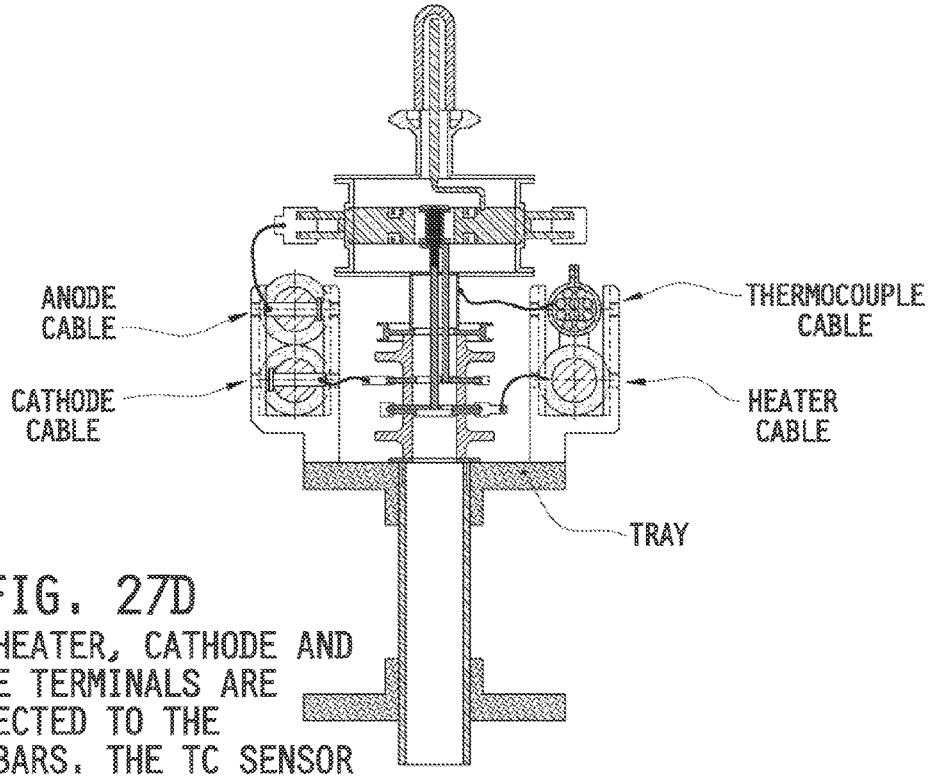
FIG. 27D illustrates an interconnection of bus-bars to a magnetron tube.

FIG. 27C illustrates a plurality of 4G magnetron tubes 1 installed on the processing tray 105. Each magnetron tube 1 may be connected to the corresponding bus-bars for the heater 121, the cathode 123, the anode 125 and the thermocouple gauge wire 127, as shown in FIG. 27D.

Figure 28:
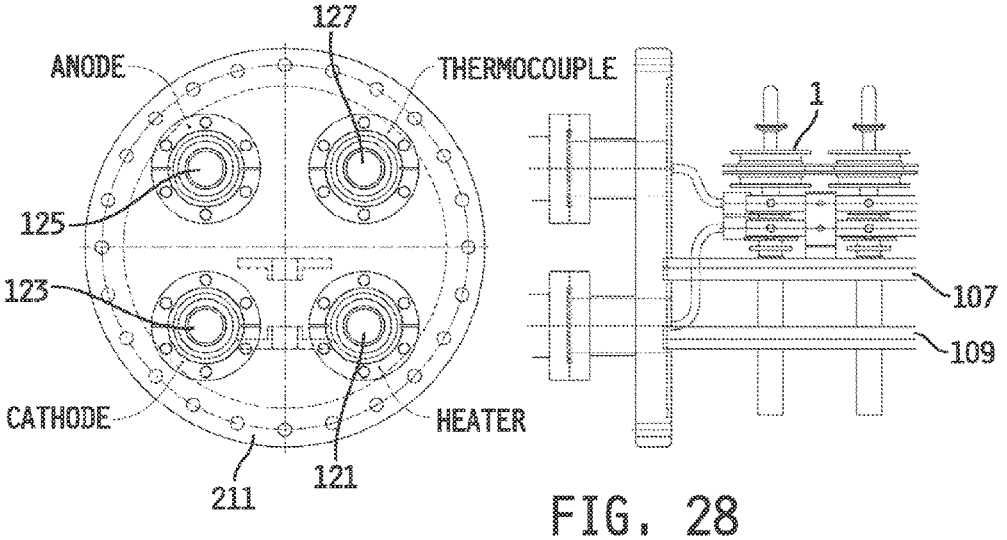
FIG. 28 illustrates a plurality of bus-bars, and a vacuum flange, for magnetron processing.

The front end of the tray 105 may be attached to a vacuum flange 211, such as a 10 inch vacuum flange, with the four bus-bars 121, 123, 125, 127 connected to appropriate feed-throughs, as shown in FIG. 28. The tray 105 may now be installed in the processing chamber.

Figure 29A:
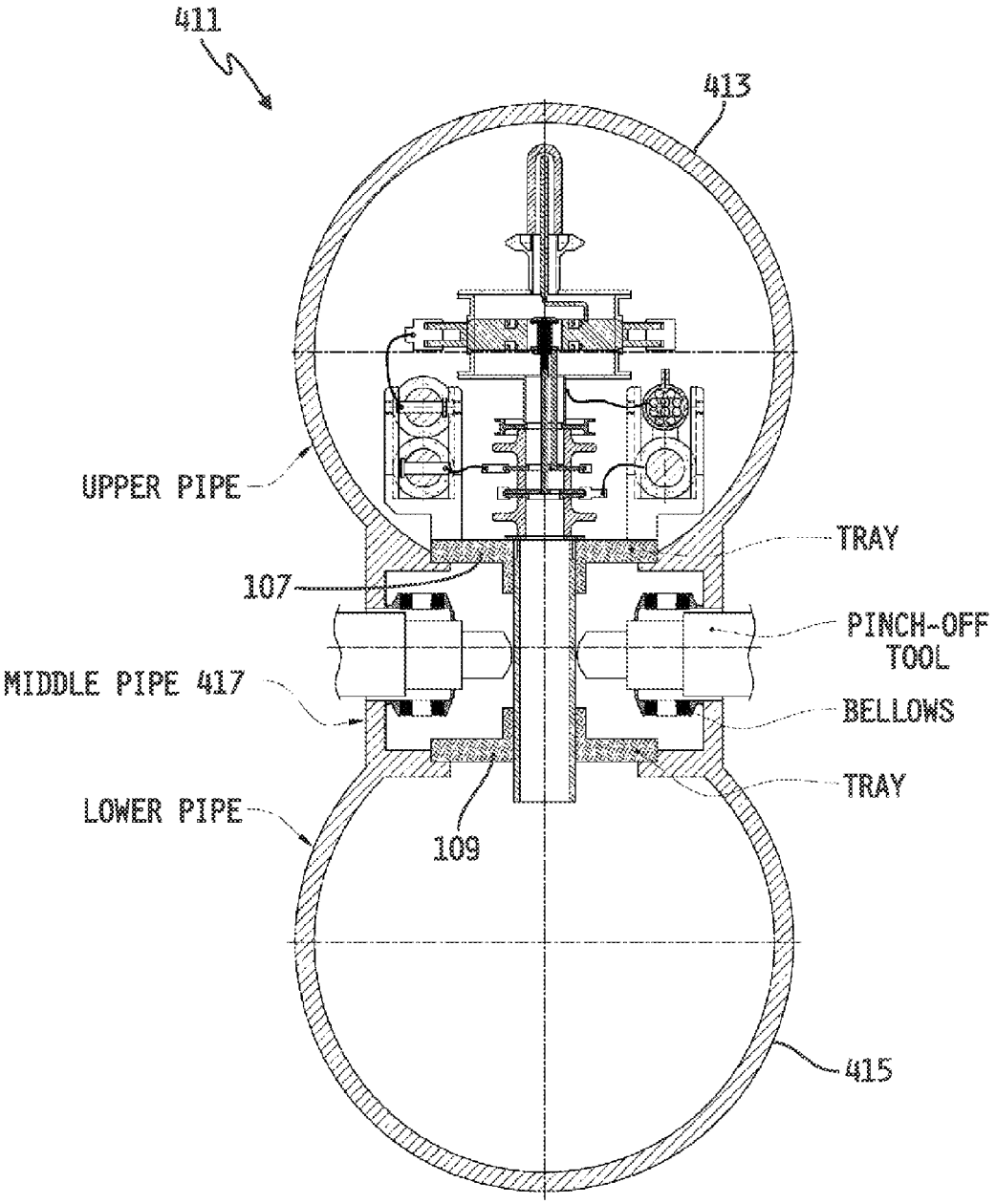
FIG. 29A illustrates a processing chamber for a magnetron.

In order to process the 4G magnetron in an UHV (Ultra High Vacuum ~10-8 Torr) environment, a batch job in a processing chamber may provide a highly suitable option. The processing chamber 411 may comprise three compartments formed from two circular cylindrical pipes, 413, 415 and one rectangular pipe 417 therebetween, as shown in FIG. 29A. FIG. 29A shows the cross sectional view of the chamber 411 with the two tiers 107, 109 of the processing tray installed. The tiers 107, 109 of the tray fit into the seats provided at the bottom of the upper pipe 413 and at the top of the lower pipe 415.

The front of the processing chamber, with the tray installed, is shown in the cross-section of FIG. 29B. The 10" vacuum flange of the tray 211 may mate with the chamber flange 611. The power supplies for the heater and the emission test may be attached at the chamber flange side end, including required gauges and meters. The smaller flange 613 at the bottom of the chamber may optionally be provided for cleaning the remnants from the pinch off, as further discussed below.

The rear of the chamber may provide capabilities for vacuum pumping, and three flanges 711*a, b, c* may thus be installed as shown in FIG. 29C. Three different vacuum pumps may be connected to these flanges, along with proper vacuum gauges, in order to provide the requisite vacuum pumping to process the magnetron tubes.

Dividing the processing chamber 411 into three separate compartments 413, 415, 417 may allow for a differential pumping system. The isolation in vacuum between these compartments is generally imperfect, at least because the tray 105 seats and the magnetron pumping port 111 are loosely fitted so some minor gapping is unavoidable. However, the seats and the fitting holes may be provided with high collars to limit the vacuum conductance through these gaps, and thus the vacuum leaking rates may be decreased. With these low leakages between the three chambers 413, 415, 417, and different conductance and a separate pump for each chamber, differential pumping may be realized.

The vacuum pump for the top pipe 413 may handle mostly the external parts of the magnetrons. The top pipe 413 may be rather crowded, so the top pipe may experience significant out-gassing from a large surface area, and a limited pumping conductance. This top pipe 413 should maintain a low 10-6 Torr during 350 C bake out, and a low 10-7 Torr when cooled to room temperature.

The middle pipe 417 may contain the pinch off knife edges, and vacuum bellows, and may serve as an intermediate vacuum chamber between the top 413 and the bottom 415 pipes. The middle pipe 417 should maintain a low 10-7 Torr during 350 C bake out, and 10-8 Torr at room temperature.

The bottom pipe 415 may serve to pump the internal parts of the magnetron. This pipe 415 may have a large pumping conductance in order to provide UHV condition to all magnetron pumping ports 111. The UHV condition may maintained throughout the bottom pipe 415, so that this pipe, in effect, provides a UHV pump connected to each magnetron. At 350 C during the bake out stage, and with full heater power provided for the cathode activation, the bottom pipe 415 should maintain a vacuum of a low 10-8 Torr. When cooled to room temperature, the vacuum should be maintained at a low 10-9 Torr.

A non-evaporating getter (NEG) pump may be provided in a thin strip form, and a few short pieces may thus be welded, such as laser welded, at the bottom cover of the magnetron. The NEG may require an activation procedure for a lengthy predetermined time at 300 C, or for a shorter time at 400 C under a UHV condition. The 4G Magnetron may necessitate a lengthy bake out time, and thus a lengthy activation at 300 C is chosen to meet the overlapping condition with the NEG activation.

For the magnetron bake out and the NEG activation, the processing chamber may be enclosed by a heater 711 comprised of a heating block containing heating strips, as is shown in FIG. 30. The bake out and the NEG activation schedule may be computer controlled in accordance with the vacuum condition in the chamber. After the bake out and the NEG activation, the heater may be turned off, and the chamber may be cooled by fan forced air 713 between the chamber and the heating jacket.

The dispenser cathode needs to be activated at around 1,100 C. This activation procedure may occur by supplying AC heater current through the lower pair of feed-throughs, namely the feed-throughs for the cathode and for the heater. The voltage and the current may then be carefully measured to indicate the cathode temperature. Throughout the activation procedure, the UHV condition should be maintained in 10-8 Torr range, and the completion of the cathode activation procedure may be assessed using an emission test.

After the cathode activation, an emission test may be performed with the heater temperature slightly lowered down to an operating temperature of 950 C. For the emission test, the anode wall of each magnetron may be connected to the anode bas bar, and a DC power supply may be connected between the anode bus bar and the cathode bus bar. Relatively low DC voltage from 0 to 100 V may be used for the emission test. The anode current as a function of the voltage may be plotted to calculate the perveance, which tells whether or not the cathode activation is complete.

When the emission test is completed, each magnetron may be sealed permanently by a pinch off process. The pinching off may be done by pinching off knives driven by hydraulic pumps. Since it takes about 10 tons of force to pinch off one magnetron, it is advantageous to arrange the chamber's hydraulic cylinders 811 in both directions, as shown in FIG. 31A. Then, the reaction forces from the two adjacent chambers are counter balanced and the hydraulic chamber does not need an extra support other than those on both ends of the array.

Figure 31B:
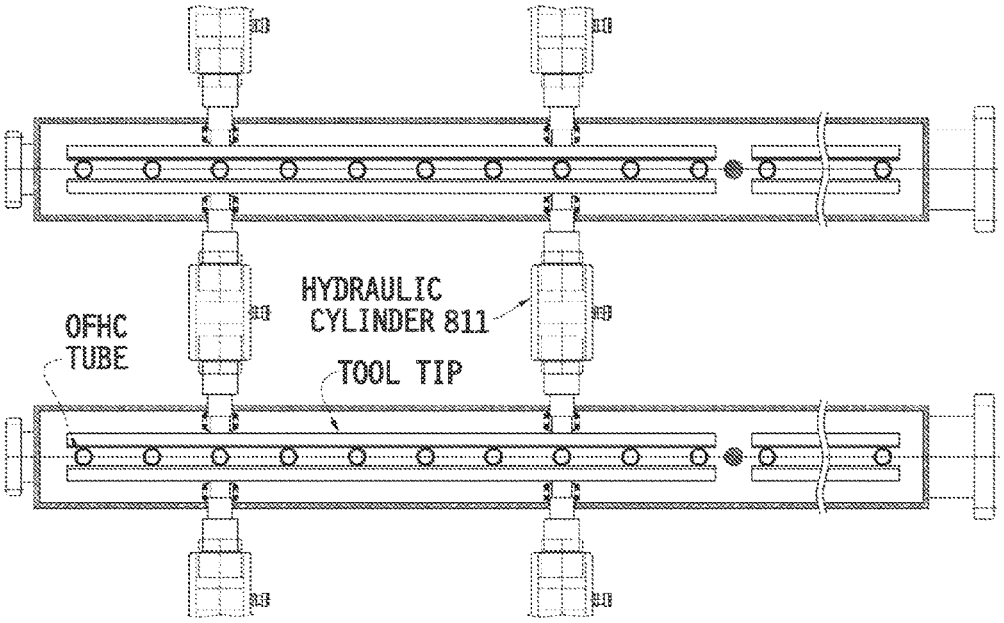
FIG. 31B illustrates pinch off systems for magnetron processing.
Figure 31C:
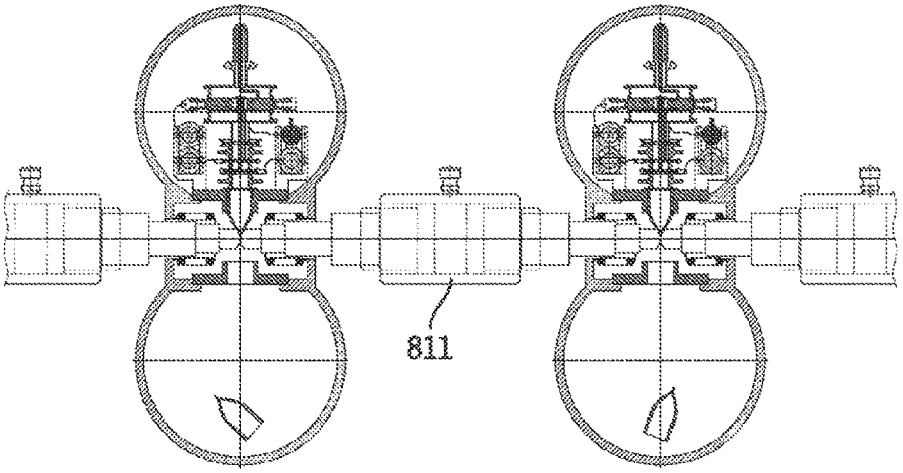
FIG. 31C illustrates pinch off systems for magnetron processing.

Up to ten magnetrons may be handled by a pair of pinching off knives that are driven by two sets of hydraulic pumps 811, as shown FIG. 31B. Each hydraulic cylinder 811 may have capability, for example, to apply 50 tons of force. FIG. 31C shows the state after the pinch off procedure is done. The processing chamber is now ready to be open to take out the processing tray. At this time, the chamber may be purged with dry nitrogen.

For mass production of the 4G magnetrons, a plurality of processing chambers may be needed, and it may be advantageous to lay them side by side in an array form. An important benefit for this array form arrangement is that the pinch off hydraulic cylinders may be counter balanced against each other and the burden for the support structure may thereby be greatly reduced, other than the ones the outer ends of the array.

A second advantage may include saving heating energy for the bake out and the NEG activation. For this purpose, it may be advantageous to put several layers on top of another. This configuration also saves the factory space. Considering the ceiling height and the working comfort, five to six layers may be advisable.

Although the invention has been described and illustrated in exemplary forms with a certain degree of particularity, it is noted that the description and illustrations have been made by way of example only. Numerous changes in the details of construction, and the combination and/or arrangement of parts and steps may be made. Accordingly, such changes are intended to be included in the invention, the scope of which is defined by the appended claims.

What is claimed is:

1. A magnetron, comprising:

an anode; and a dispenser cathode located coaxially within said anode, wherein the anode comprises:

an internal structure forming a plurality of resonant cavities arranged around the dispenser cathode, and residing in a plane orthogonal to the dispenser cathode, and a plurality of radially outward anode cooling fins having a large surface area; and an outside wall that has top and bottom portions disposed above and below the internal structure respectively, wherein the internal structure comprises a first high thermal conductivity material, and the top and bottom portions of the outside wall comprise a low thermal conductivity material, and wherein the plurality of radially outward anode cooling fins comprise the first high thermal conductivity material, and are fixedly coupled to a conduction cooling block, wherein the conduction cooling block comprises:

a second high thermal conductivity material, wherein the conduction cooling block has a first large surface area disposed adjacent to the large surface area of the plurality of radially outward anode cooling fins and has a second large surface area exposed to the atmosphere, wherein the first large surface area of the conduction cooling block is provided by at least one thick cooling fin interlaced with and slidingly fitted to the plurality of radially outward anode cooling fins, and the second large surface area of the conduction cooling block is provided by a plurality of grooves exposed to the atmosphere.

2. The magnetron of claim 1, wherein the internal structure comprises:

a cylindrical member on which the top and bottom portions of the outside wall are constructed; and anode vanes disposed within the cylindrical member which define the plurality of radially outward resonant cavities therebetween, wherein the anode vanes comprise a wedge shape, and have thicker heads at inner tips.

3. The magnetron of claim 2, further comprising:

a plurality of strap rings concentrically secured about portions of the anode vanes to thereby reduce electromagnetic leakage power and to thereby increase RF power efficiency, wherein each of the plurality of strap rings forms top and bottom strap ring portions that are symmetric with respect to one another.

4. The magnetron of claim 1, wherein the plurality of radially outward anode cooling fins are brazed with the conduction cooling block.

5. The magnetron of claim 1, wherein the first high thermal conductivity material is copper, the low thermal conductivity material is stainless steel, and the second high thermal conductivity material is aluminum.

6. The magnetron of claim 1, further comprising:

top and bottom anode covers respectively attached to the top and bottom portions of an anode outside wall, and each comprising the same or a different low thermal conductivity material; and top and bottom magnets wherein the top magnets are above the top anode cover, and wherein the bottom magnets are below the bottom anode cover.

7. The magnetron of claim 6, further comprising:

first and second magnetic flux having return paths, each coupled to both top and bottom magnets to form a magnetic circuit; and first and second pole pieces each fixedly attached to a respective one of the top and bottom magnets, and each configured with an extruded central portion concentric with a center of an attached magnet, and a thin flat outer portion extending outward from a central portion to or near an outer edge of the attached magnet.

8. The magnetron of claim 6, wherein the top and bottom magnets comprises high residual magnets having strong coercive force.

9. The magnetron of claim 6, wherein the top and bottom magnets comprises one selected from a group consisting of SmCo and NdFe.

10. The magnetron of claim 9, wherein the top and bottom magnets possess low temperature coefficients.

* * * * *